US006903710B2

(12) United States Patent
Ooe et al.

(10) Patent No.: US 6,903,710 B2
(45) Date of Patent: Jun. 7, 2005

(54) METHOD OF DRIVING DISPLAY DEVICE CAPABLE OF ACHIEVING DISPLAY OF IMAGES IN HIGHER PRECISION WITHOUT CHANGING CONVENTIONAL SPECIFICATIONS OF PANEL

(75) Inventors: Takayuki Ooe, Kawasaki (JP); Toshio Ueda, Kawasaki (JP); Kosaku Toda, Kawasaki (JP); Kyoji Kariya, Kawasaki (JP); Shigeo Mikoshiba, 2-43-17, Izumi, Suginami-ku, Tokyo (JP), 168-0063; Tomokazu Shiga, Kawasaki (JP); Makiko Yamada, Fujisawa (JP)

(73) Assignees: Shigeo Mikoshiba, Tokyo (JP); Fujitsu Hitachi Plasma Display Limited, Kawasaki (JP)

( * ) Notice: Subject to any disclaimer, the term of this patent is extended or adjusted under 35 U.S.C. 154(b) by 257 days.

(21) Appl. No.: 09/930,183

(22) Filed: Aug. 16, 2001

(65) Prior Publication Data

US 2002/0063729 A1 May 30, 2002

(30) Foreign Application Priority Data

Nov. 28, 2000 (JP) ..... 2000-360760
Apr. 5, 2001 (JP) ..... 2001-107640

(51) Int. Cl.[7] ..... G09G 3/28
(52) U.S. Cl. ..... 345/63; 313/492
(58) Field of Search ..... 313/484–493; 345/60, 63, 100, 694, 696

(56) References Cited

U.S. PATENT DOCUMENTS

| | | | | | |
|---|---|---|---|---|---|
| 4,692,662 | A | * | 9/1987 | Wada et al. | 313/493 |
| 5,907,316 | A | | 5/1999 | Mikoshiba et al. | |
| 6,473,464 | B1 | * | 10/2002 | Weitbruch et al. | 375/240.26 |
| 6,529,204 | B1 | * | 3/2003 | Mikoshiba et al. | 345/597 |
| 6,580,227 | B2 | * | 6/2003 | Kobayashi | 315/169.4 |

FOREIGN PATENT DOCUMENTS

| | | | | |
|---|---|---|---|---|
| EP | 0 840 274 | | 5/1998 | |
| FR | 2 781 966 | | 2/2000 | |
| JP | 11-249617 | | 9/1999 | |
| JP | 2000-163004 | | 6/2000 | |
| JP | 2000-163013 | * | 6/2000 | G09G/3/28 |

OTHER PUBLICATIONS

Yamada, M., et al., "Doubling of PDP Resolution for Moving Pictures by Use of a Virtual Pixel Technique", IDW '00, pp. 703–706.

* cited by examiner

*Primary Examiner*—Amare Mongistu
*Assistant Examiner*—Tom Sheng
(74) *Attorney, Agent, or Firm*—Staas & Halsey LLP

(57) ABSTRACT

A method of driving a display device assumes a specific pixel on a retina that is formed on the retina based on an input image, and controls light emission of each subframe such that luminance of a specific pixel on the retina becomes substantially equal to luminance of a pixel corresponding to the input image. The display device is driven by constructing one frame with a plurality of subframes, for displaying the input image that moves on a display panel.

13 Claims, 38 Drawing Sheets

A: NON-REDUNDANT LIGHT-EMITTING BLOCK
D: REDUNDANT LIGHT-EMITTING BLOCK

※ REDUNDANT=THERE EXISTS OTHER LIGHT -EMITTING BLOCK HAVING THE SAME LIGHT EMISSION PERIOD WITHIN ONE FRAME

POSITION
0 0 0 0 0 0 0
255 255 255 255 255 255

128

0 0 0 0 0 0 0
255 255 255 255 255 255

METHOD OF DRIVING DISPLAY DEVICE CAPABLE OF ACHIEVING DISPLAY OF IMAGES IN HIGHER PRECISION WITHOUT CHANGING CONVENTIONAL SPECIFICATIONS OF PANEL

BACKGROUND OF THE INVENTION

1. Field of the Invention

The present invention relates to a method of driving a display device, and more particularly, to a method of driving a display device for displaying halftone images in frames each divided into a plurality of subframes by using an intra-frame time-division method (subframe method) like a plasma display panel (PDP).

2. Description of the Related Art

Recently, along the trend of large-type display devices, thin-type display devices have been required, and various kinds of thin-type display devices have been provided. For example, there have been provided matrix panels for directly displaying digital signals, such as gas-discharge panels like PDPs, DMDs (Digital Micromirror Devices), EL (Electro Luminescence) display devices, fluorescent display tubes, and liquid crystal display devices. Among these thin-type display devices, gas-discharge panels (for example, PDPs) can easily employ large screens because of a simple process, have excellent display quality because of a self-light-emission type, and have a quick response speed. Because of these advantages, the gas-discharge panels are considered to be a most promising candidate for use as display devices for large-screen and direct-viewing HDTVs (High Definition Televisions).

Conventionally, an intermediate tone display method of a PDP is carried out according to an intra-frame (intra-field) time-division method (subframe (subfield) method), for example. One frame (field) consists of N subframes (subfields: light-emitting blocks) of SF1 to SFN with different weights of luminance. When the interlaced operation is carried out, one frame consists of two fields of an even number field and an odd number field. These frames are essentially equivalent to frames, and in the present specification, these fields are also referred to as frames. In the present specification, description will be made based on the assumption that one pixel consists of three sub-pixels of R (red), G (green), and B (blue). While the PDP will be taken as an example in the following explanation, the present invention is not limited to the PDP, and the present invention can be widely applied to display devices for carrying out a halftone (gradation) display using the intra-frame time-division method.

As a gradation display system for the display device like the PDP, the intra-frame time-division method is usually used. This intra-frame time-division method is characterized in that the light emission period per one TV frame of each pixel expands to a maximum one TV frame. Accordingly, when an image moves and when the viewpoint of an observer (user) of a display device traces this moving image, the light emission of this pixel expands on the retina of the observer by the pixels that move in one TV frame.

Conventionally, when a moving picture is displayed on the PDP, there has been a problem that the edge portion of the display image becomes indistinct. This is because of an afterimage effect of the observer that occurs when the viewpoint of the observer traces the moving image. This disturbance is called a moving picture counterfeit outline (color counterfeit outline), and this phenomenon occurs based on the same principle as that of the large problem of the PDP as described above.

As methods of reducing this moving picture counterfeit outline, there have been proposed a method of increasing the number of light-emitting blocks by decreasing the number of gradations, and a method of a superimposed processing for restricting the move of the weight of the light emission. These methods have been proposed in Japanese Unexamined Patent Publication (Kokai) Nos. 10-039828, 10-133623, 11-249617, 2000-105565, and 2000-163004. A method of assuming an image on retina is disclosed in detail, for example, in Japanese Unexamined Patent Publication (Kokai) No. 2000-105565 that is described later.

However, when these conventional methods are used, the indistinctness of the edge portion of the image is further emphasized. Therefore, in order to obtain a natural expression of images, it is necessary to reduce the moving picture counterfeit outline without decreasing the number of gradations.

Further, in order to realize a panel for achieving a higher-precision display, it is necessary to increase the address speed, and further, a sophisticated manufacturing technique is required as well. It is not easy to increase the resolution of the PDP based on the current techniques. Further, a high resolution brings about a reduction in the luminous efficiency due to a reduction in the sizes of discharge cells.

SUMMARY OF THE INVENTION

An object of the present invention is to provide a method of driving a display device capable of achieving a display of images in higher precision without changing the conventional specifications of panels, as well as capable of solving the indistinctness of the edge portion of moving pictures.

According to the present invention there is provided a method of driving a display device by constructing one frame with a plurality of subframes, for displaying an input image that moves on a display panel, wherein the method assumes a specific pixel on a retina that is formed on the retina based on the input image, and controls light emission of each subframe such that luminance of the specific pixel on the retina becomes substantially equal to luminance of a pixel corresponding to the input image.

The method may control the light emission of each subframe based on a move direction and a speed of motion of the input image that moves on the display panel. The method may assume tracks of each pixel formed on the retina based on move of the input image, and may control the light emission of each subframe corresponding to the tracks substantially included in an area of the specific pixel on the retina. Light emission of the specific pixel on the retina may be the light emission of subframes, included in the tracks of the specific pixel on the retina or adjacent or neighboring pixels on the retina, and corresponding to the tracks substantially included in the area of the specific pixel on the retina. A pitch of pixels on the retina in the light emission area of each subframe that is used for displaying the specific pixel on the retina, may be made shorter than a pitch of pixels on the display panel. The pitch of the pixels on the retina may be selected as one half of the pitch of the pixels on the display panel. When one frame of the pixels on the retina is constructed of N subframes, two sets of the N subframes may be provided per one frame period, for the pixels on the display panel. One set of the N subframes may be provided for each of a front half and a latter half of the one frame period, for the pixels on the display panel.

The pitch of the pixels on the retina may be limited by the speed of motion of the image that moves on the display panel, and number of redundant light-emitting blocks of subframes that constitute the one frame. The redundant light-emitting blocks may be selected based on light-emitting blocks located either at the near of or far from one end of the specific pixel on the retina, with priority. The redundant light-emitting blocks may be selected based on light-emitting blocks located either at the beginning or at the end of one frame period for displaying the specific pixel on the retina, with priority. The light emission of the subframes may be controlled such that luminous colors of the specific pixel on the retina become substantially equal to luminous colors of the corresponding pixel in the input image.

Further, according to the present invention there is provided a display device displaying an input image that moves on a display panel by constructing one frame with a plurality of subframes, comprising an assuming unit assuming a specific pixel on a retina that is formed on the retina based on the input image; and a control unit controlling light emission of each subframe such that luminance of the specific pixel on the retina becomes substantially equal to luminance of a pixel corresponding to the input image.

Slits may be provided at light-extracting portions of each light-emitting cell that constitutes the display panel, thereby to limit the effective area of the light-extracting portions. The slits may be formed substantially in a horizontal direction with respect to the light-emitting cells. The slits may be formed substantially in a vertical direction with respect to the light-emitting cells. The slits may be formed in a cross shape by combining substantially horizontal and vertical directions with respect to the light-emitting cells.

A light-shielding dielectric may be provided on a substrate in order to form the slits, the light-shielding dielectric may have black color at an observer side, and the light-shielding dielectric may have white color at a side opposite to the observer side. An ultraviolet-ray excitation phosphor may be coated on an inner wall surface of the light-shielding dielectric. The display device may be a plasma display device.

As described above, according to a method of driving a display device of the present invention, it is possible to reduce the moving picture counterfeit outline (pseudo counter of a moving picture) by matching an input image with an image focused on the retina. Further, by utilizing the spread of the light emission of moving pictures, it is possible to realize a display of a higher precision based on the precision of the input image without increasing the precision of the panel itself.

The display device like the PDP usually uses the intra-frame time-division method as a gradation display system. In this case, when an image moves and when the viewpoint of the observer traces this moving image, the light emission of this pixel expands on the retina of the observer by the pixels that move in one TV frame. According to the present invention, a plurality of pixels (for example, two pixels) are prepared virtually within one pixel on the retina corresponding to one pixel on the panel, by controlling the spread of the light emission of the pixel on the retina of the observer. With this arrangement, the resolution of the image is improved by a plurality of times (for example, two times) in the move direction of the image. Namely, the present invention provides a driving method for a display device (a virtual pixel technique) that improves the resolution of moving pictures by utilizing the spread of the light emission of the moving pictures.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMODIMENTS

Embodiments of the method of driving (virtual pixel technique) a display device relating to the present invention will be explained in detail with reference to the drawings. The application of the method of driving a display device relating to the present invention is not limited to the PDP, and the present invention can be widely applied to display devices for carrying out a gradation display using the intra-frame time-division method. In other words, it is possible to apply the present invention to various display devices for carrying out a gradation display by dividing one frame period into a plurality of subframes having a plurality of various light emission periods.

Figure 1A:
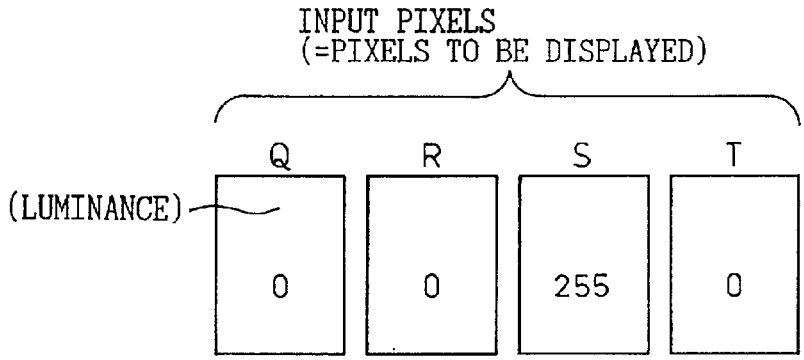
FIG. 1A and FIG. 1B are diagrams showing pixels to be displayed and pixels (in the case of stationary pictures) assumed on the retina corresponding to these pixels.
Figure 1B:
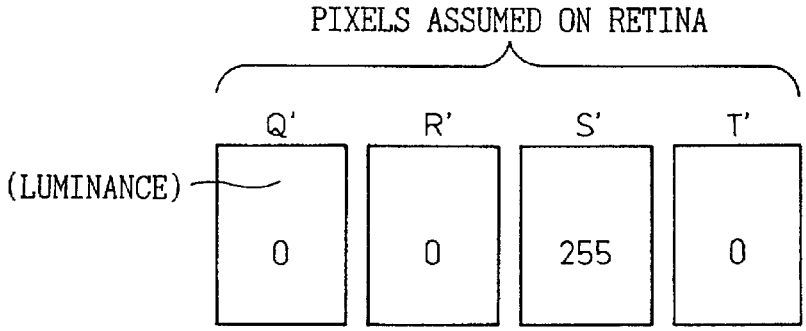
Figure 2:
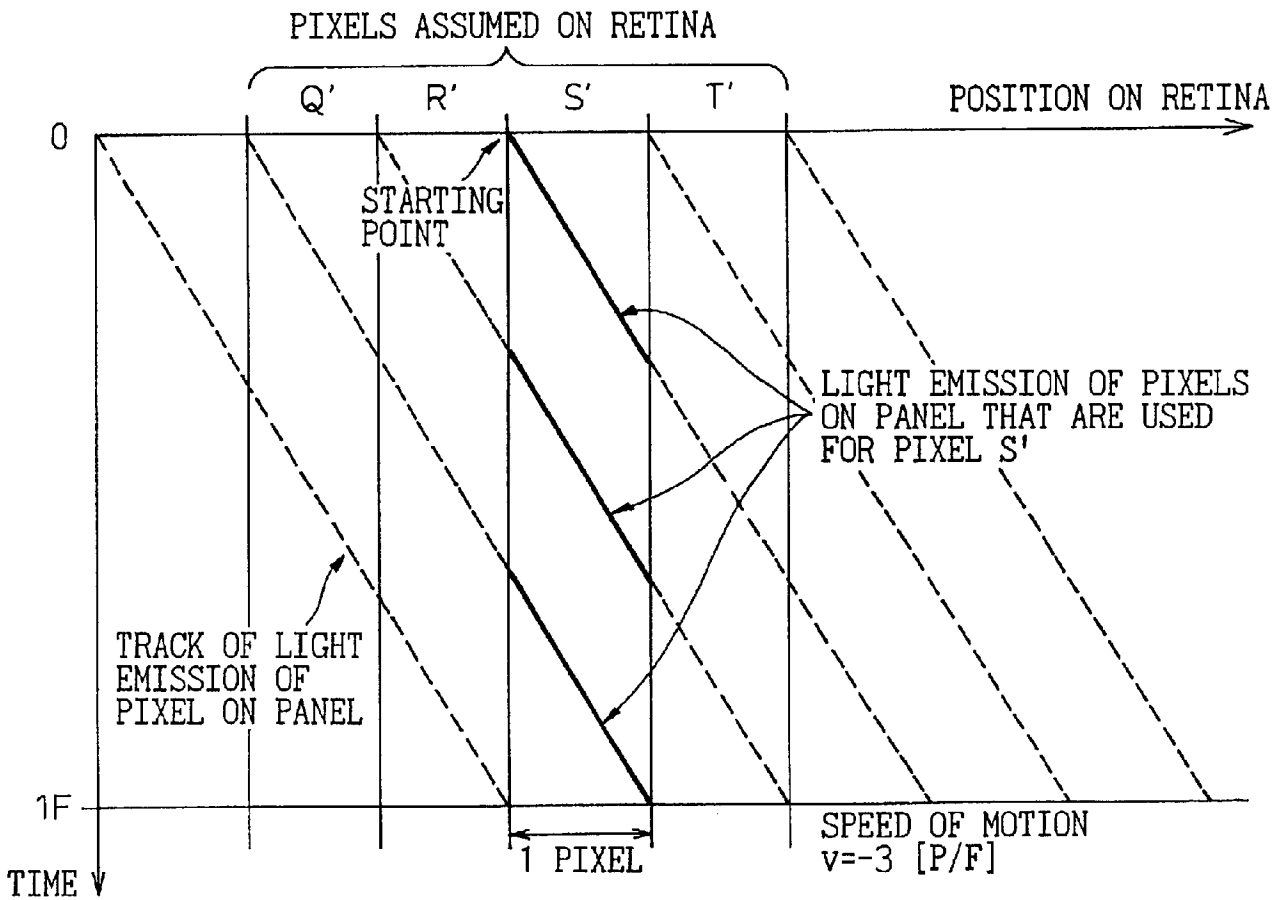
FIG. 2 is a diagram showing tracks of light emission of pixels on the panel used for expressing a pixel S' assumed on the retina (an ideal case)

FIG. 1A and FIG. 1B are diagrams showing pixels to be displayed and pixels (in the case of stationary pictures) assumed on the retina corresponding to these pixels. FIG. 2 is a diagram showing tracks of light emission of pixels on the panel used for expressing a pixel S' assumed on the retina (an ideal case). FIG. 1A shows pixels to be input to a display device (PDP) (pixels to be displayed), and FIG. 1B shows pixels assumed on the retina of an observer (user) of the display device based on the input pixels. Each pixel includes three sub-pixels of R, G and B.

As shown in FIG. 1A and FIG. 1B, in the case of a stationary picture, the luminance of each of the input pixels Q, R, S and T straightly becomes the luminance of corresponding one of pixels Q', R', S' and T' assumed on the retina. In other words, the pixel S of the luminance 255 on the display device (PDP) becomes the pixel S' with the luminance 255 on the retina of the observer.

However, as shown in FIG. 2, when an image has moved from the right to the left on the PDP (panel) during one frame period (1F) (at a speed of motion V=−3 [P/F: Pixel/Frame (pixel/Field)], the light emission of the pixels Q', R', S' and T' on the retina of the observer leaves tracks as shown by broken lines in FIG. 2 on the retina, unless any processing is carried out. When the image moves from the right to the left on the panel, the eyes of the observer follow this pattern. Therefore, the image projected to the retina makes a relative move from the left to the right direction on the retina. It is assumed that the move of an image from the left to the right direction on the panel is expressed as positive (+), and the move of an image from the right to the left direction on the panel is expressed as negative (−).

When the image moves as explained above, tracks are utilized for making the luminance of a pixel assumed on the retina coincide with the luminance of the input pixel. For example, in the case of expressing the pixel S' assumed on the retina, light is emitted on tracks expressed by thick lines within the width of the pixel S' as shown in FIG. 2. With this arrangement, it is possible to light the pixel S' with the same luminance as that of the input pixel. This is because the length of the track of the original pixel (a total length of a broken line that extends from the left end of S' to the right downward direction at time 0) coincides with a total length of the thick line parts.

Based on the above, the position and the luminance on the retina coincides with the position of the input pixel. As a result, the moving picture counterfeit outline is reduced. In this case, when the original pixel S has luminance of emitting light in all the subframes (SF1 to SFN: the light-emitting blocks A, D, D, D, D, D, D, D), all the thick line parts are made to emit light. When the pixel S has luminance for emitting light in a specific subframe, optional portions within the thick line parts are made to emit light, and the luminance of the total light-emitted portions is controlled to coincide with the luminance of the pixel S.

Figure 3:
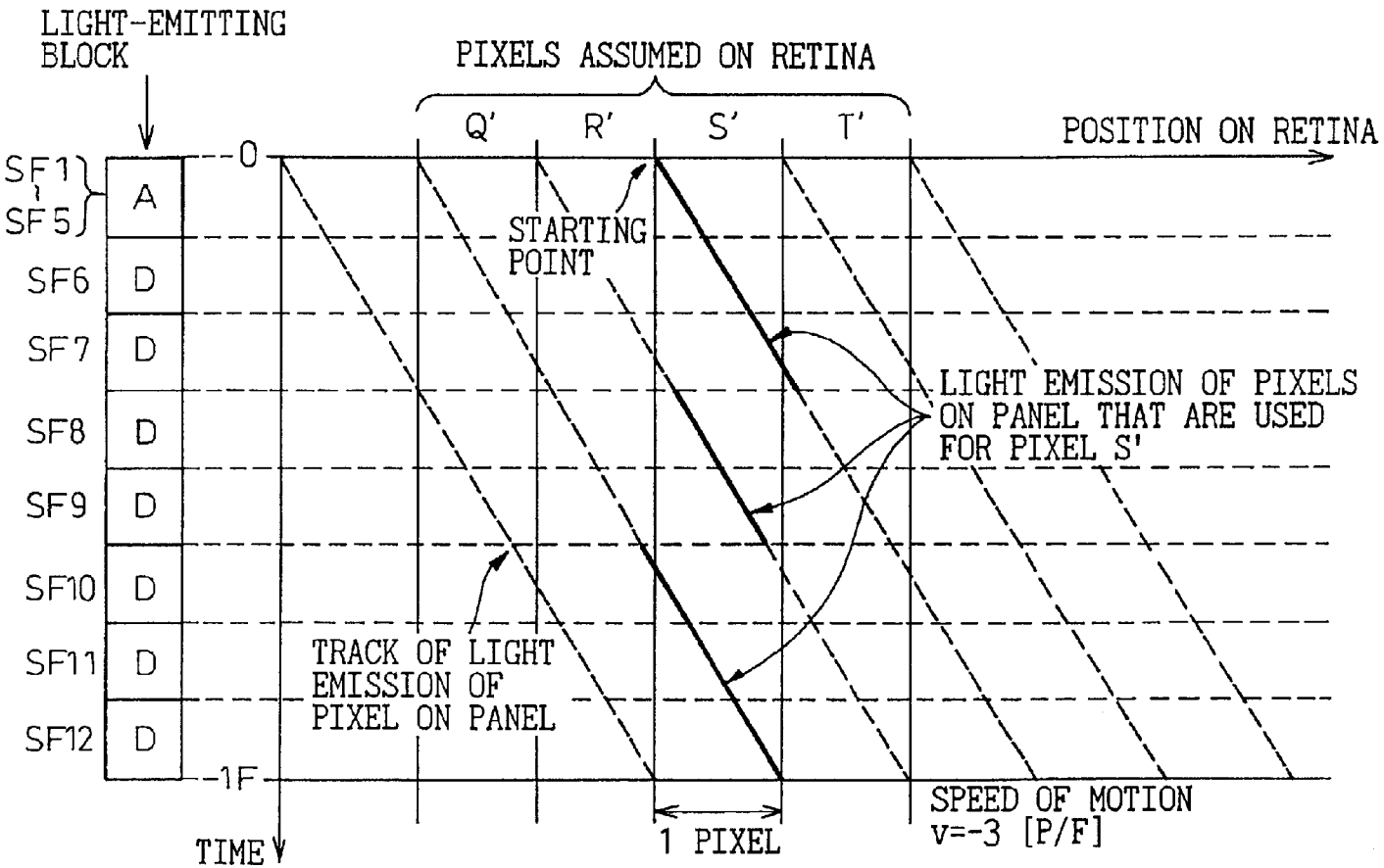
FIG. 3 is a diagram showing tracks of light emission of pixels on the panel used for expressing a pixel S' assumed on the retina (a case of considering light emitting blocks)

FIG. 3 is a diagram showing tracks of light emission of pixels on the panel used for expressing a pixel S' assumed on the retina (a case of considering light emitting blocks). In FIG. 3, a reference symbol A represents a non-redundant light-emitting block in FIG. 29 (a sum of subframes of gradation levels 1, 2, 4, 8 and 16: a total of subframes SF1 to SF5). A reference symbol D represents a redundant light-emitting block shown in FIG. 29 (each of subframes SF6 to SF12 of each gradation level 32), for example. Reference symbols Q', R', S' and T' represent pixels on the retina corresponding to pixels Q, R, S and T on the PDP. In FIG. 3, a vertical axis represents time (1F: one frame), and a horizontal axis represents a position on the retina. When the speed of motion V of an image is negative (for example, V=−3 [P/F]), a starting point of the pixel S' assumed on the retina is at the left upper end of the area of the pixel S' in FIG. 2 and FIG. 3 respectively.

Figure 29:
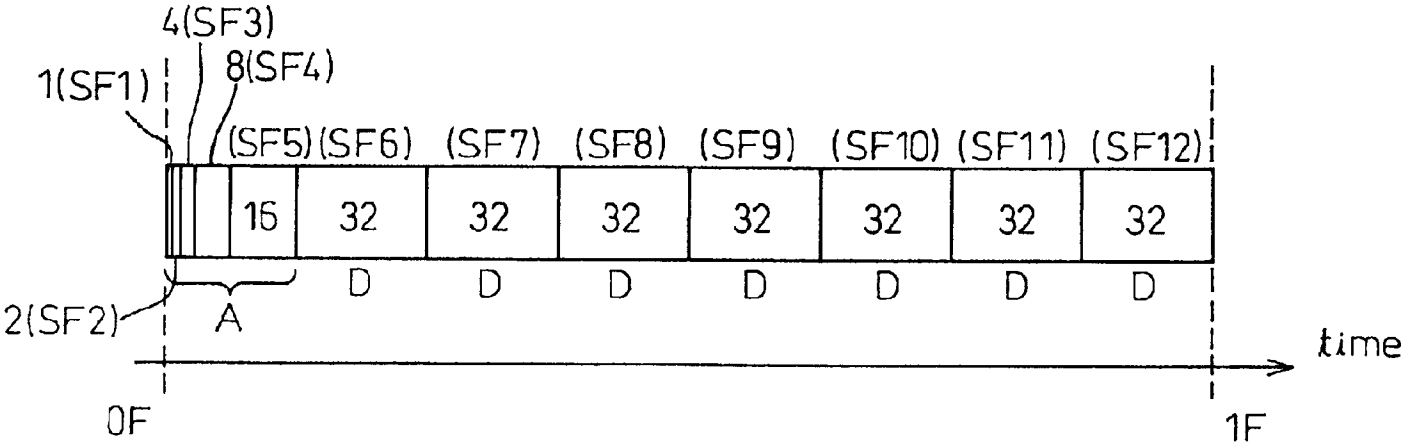
FIG. 29 is a diagram showing an example of a subframe array applied to the present invention.

Tracks of light emission that can be actually used are limited to the subframe light emission periods. When twelve SFs (subframes) as shown in FIG. 29 to be described later are used, for example, the thick line parts shown in FIG. 3 are selected.

Referring to FIG. 3, among the three slanted lines (thick line parts) that constitute the pixel S', the right lower portion of the top thick line slightly entered the adjacent pixel T' area. This is because one light-emitting block (D) corresponding to the pixel S' has a length equal to one subframe (refer to D in FIG. 29). Therefore, it is not possible to control to stop the light emission in the middle of one subframe although the light emission has entered the area of the pixel T'. Similarly, the left upper portion of the bottom thick line also slightly entered the area of the adjacent pixel R'.

There is a case where it is not possible to make the luminance of the pixel on the retina completely coincide with the luminance of the input pixel because of the subframes, although it is ideal to achieve this coincidence as shown in FIG. 2. In this case, the light emission/non-emission is controlled in each light-emitting block in order to obtain the luminance as close to the luminance of the original pixel S as possible. FIG. 6 to FIG. 9 show detailed methods of determining the light-emitting block.

Figure 6:
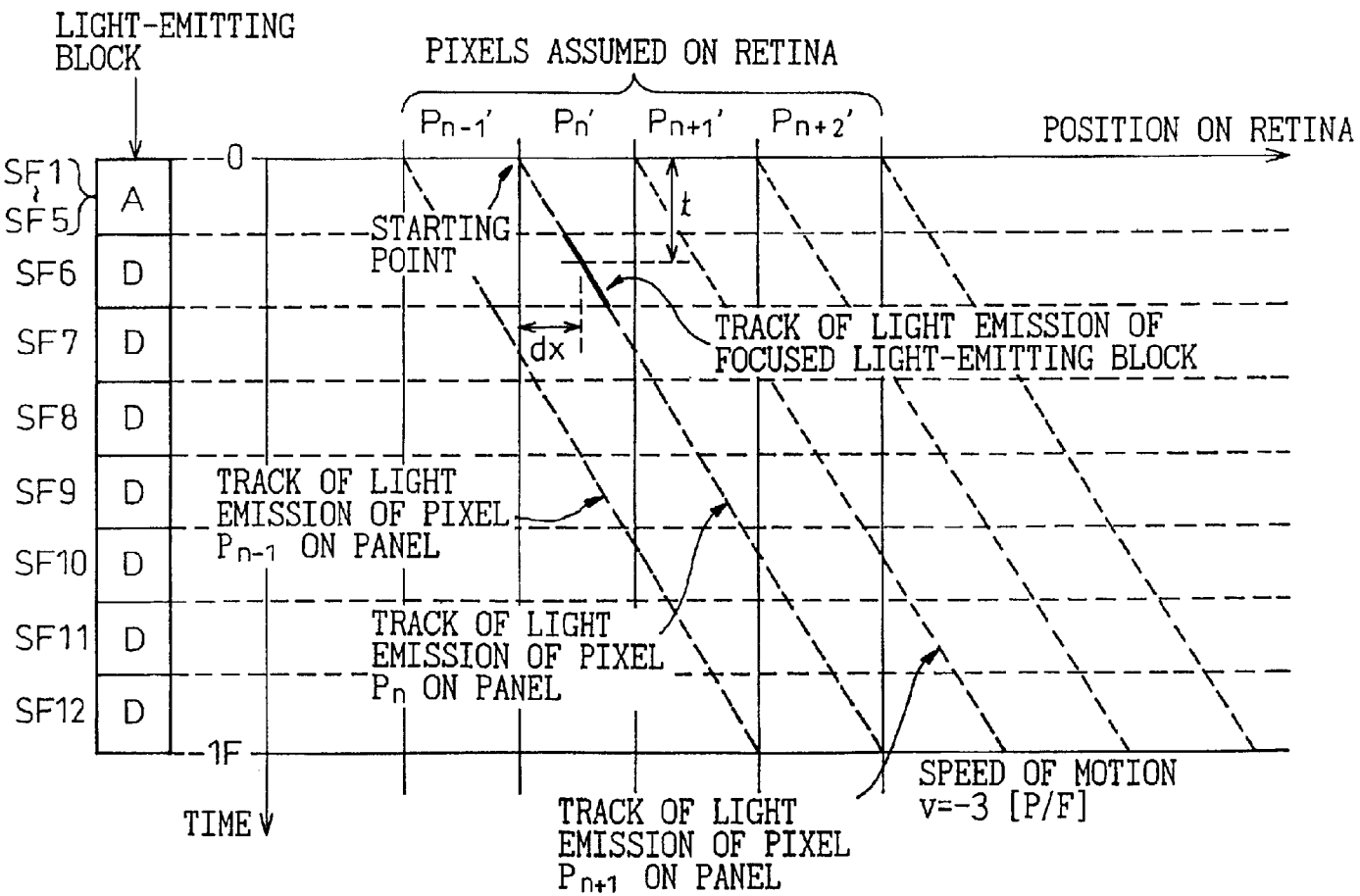
FIG. 6 is a diagram showing time and distance to the center of a track of a light emission of a focused light-emitting block in a pixel $P_n$ on the panel.
Figure 7:
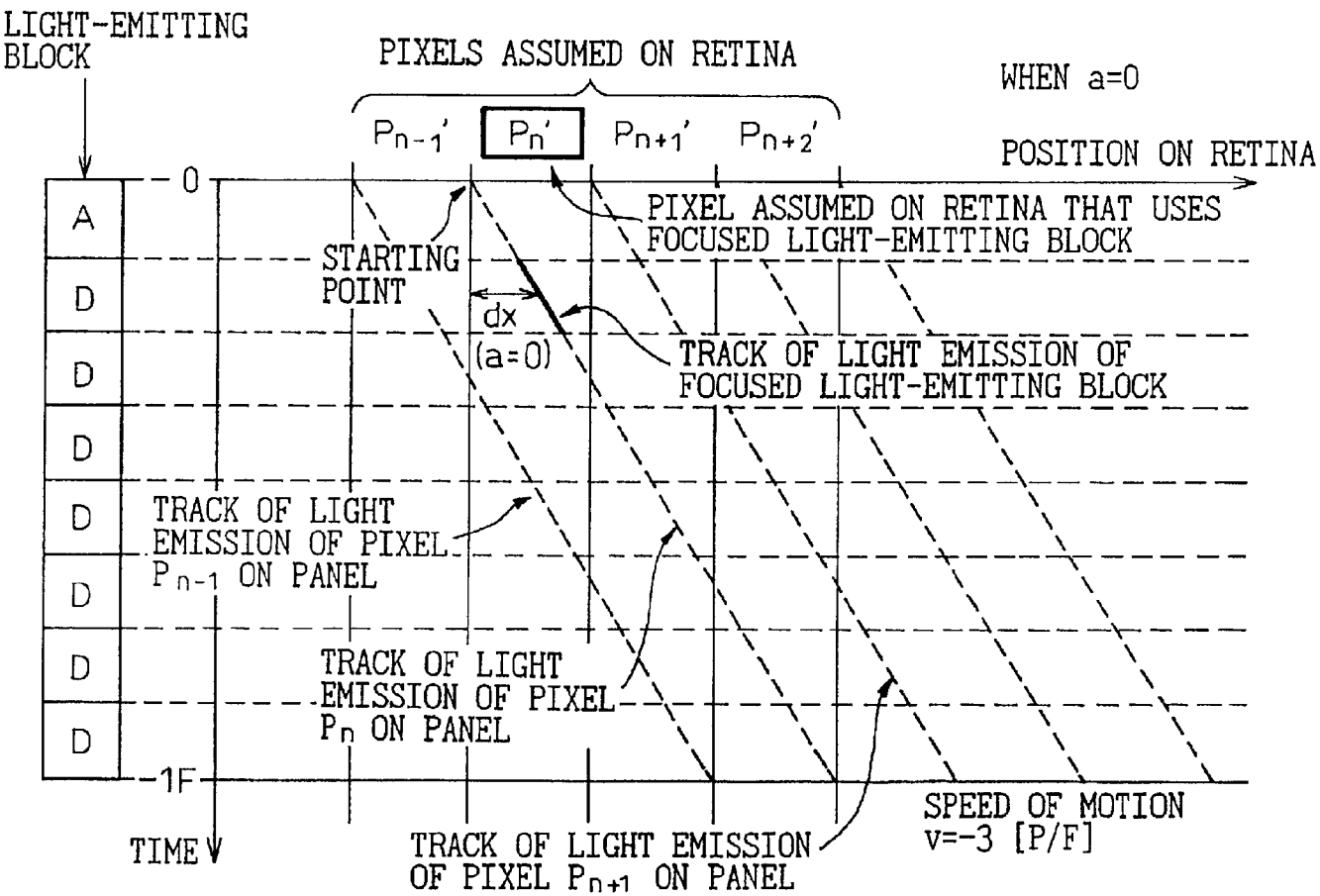
FIG. 7 is a diagram showing a case where a=0 in FIG. 6.
Figure 8:
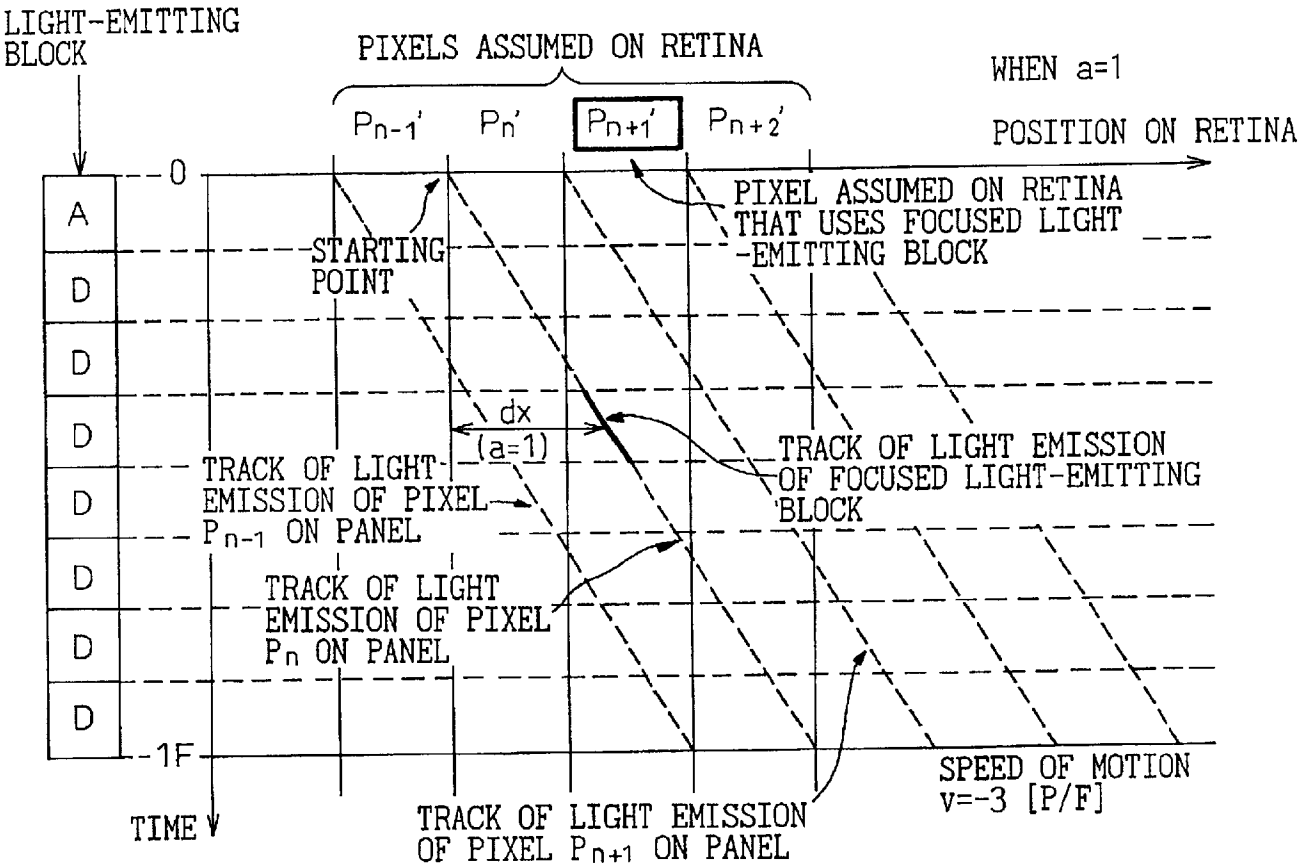
FIG. 8 is a diagram showing a case where a=1 in FIG. 6.
Figure 9:
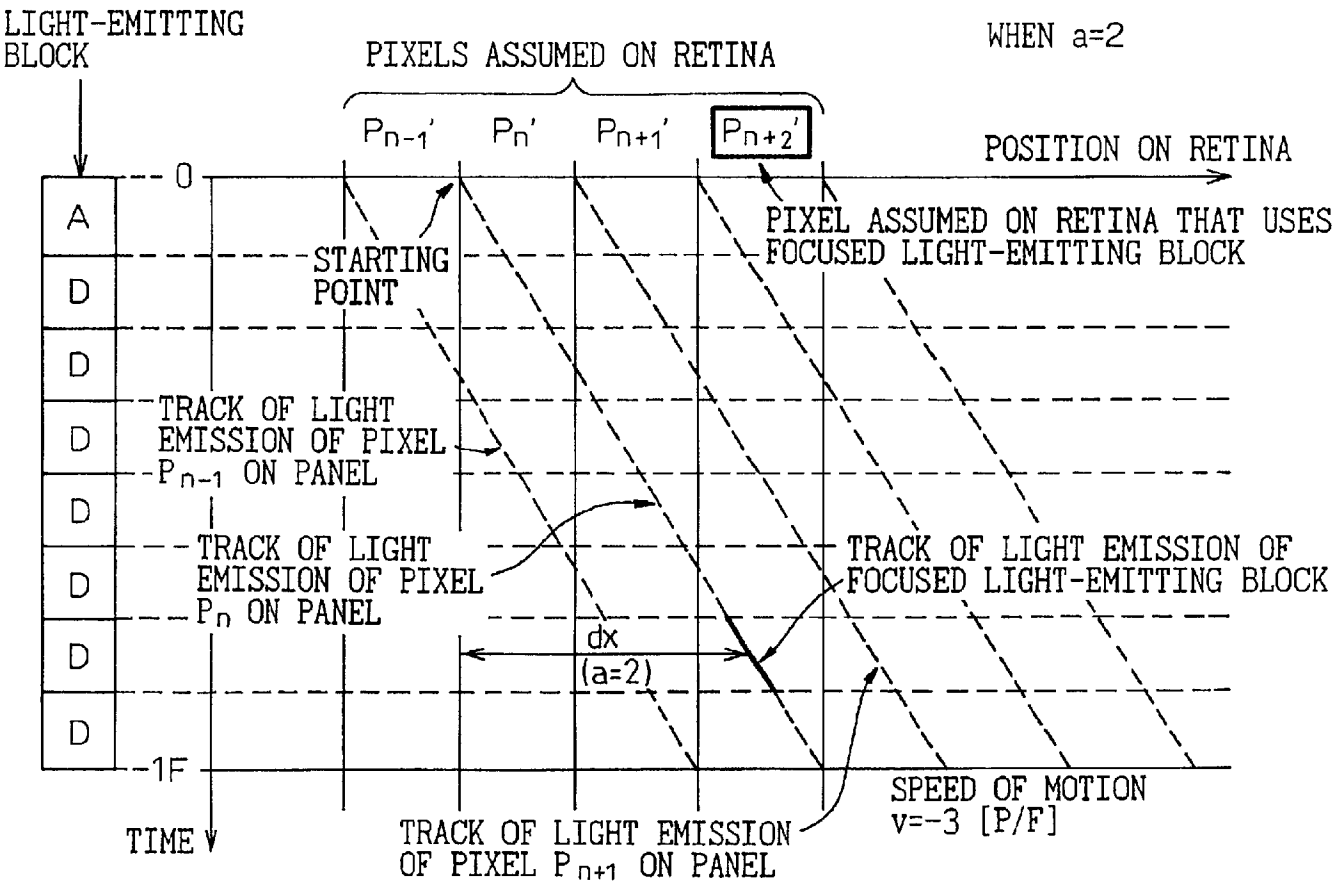
FIG. 9 is a diagram showing a case where a=2 in FIG. 6.

FIG. 6 is a diagram showing time and distance to the center of a track of a light emission of a focused light-emitting block in a pixel $P_n$ on the panel. FIG. 7 is a diagram showing a case where a=0, FIG. 8 is a diagram showing a case where a=1, and FIG. 9 is a diagram showing a case where a=2. A starting point of the pixel $P_n'$ assumed on the retina is at the left upper end of the area of the pixel $P_n'$ in each of these drawings.

FIG. 6 is a diagram showing the principle of determining in which pixels the light-emitting blocks that constitute the pixel $P_n$ on the panel (PDP: display device) are used. In FIG. 6, in order to avoid confusion, it is assumed that the pixel on the panel is $P_n$ (=a pixel at an n-th position on the panel), and the corresponding pixel assumed on the retina is $P_n'$. Pixels $P_{n-1}'$, $P_{n+1}'$, and $P_{n+2}'$ that are assumed on the retina correspond to pixels $P_{n-1}$, $P_{n+1}$, and $P_{n+2}$ on the panel respectively. In the following explanation, the reference symbol a represents a value obtained from a=int (dx/one pixel width on retina).

First, a time t and a position dx from the starting point of the light emission of the pixel $P_n$ on the panel to the center of the light emission of the focused light-emitting block are calculated. When an image moves on the panel from the right to the left direction (a speed of motion V=−3 [P/F]) during one frame period (1F), and also when a=0, this light-emitting block is used for the pixel $P_n'$ on the retina, as shown in FIG. 7. When an image moves on the panel at a speed of motion V=−3 [P/F]) during one frame period (1F), and also when a=1, this light-emitting block is used for the pixel $P_{n+1}'$ on the retina, as shown in FIG. 8. Further, when an image moves on the panel at a speed of motion V=−3 [P/F]) during one frame period (1F), and also when a=2, this light-emitting block is used for the pixel $P_{n+2}'$ on the retina, as shown in FIG. 9.

Figure 10:
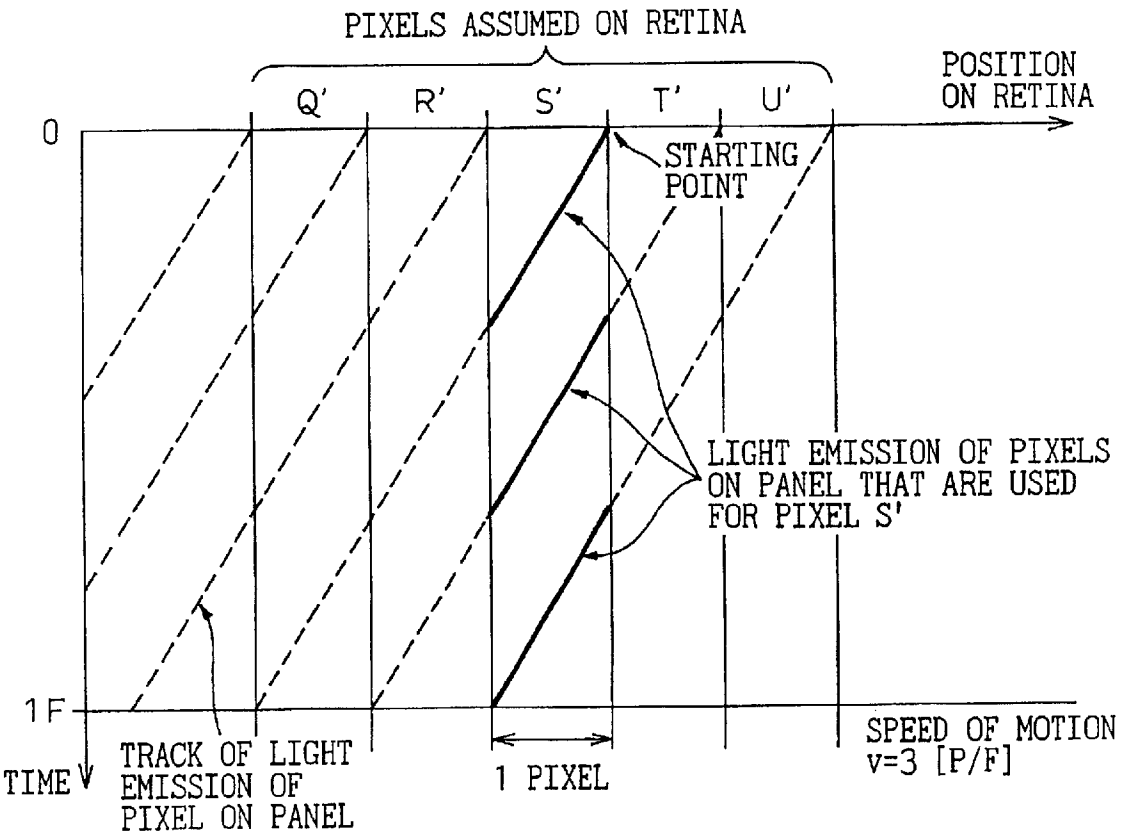
FIG. 10 is a diagram showing tracks of light emission of pixels on the panel used for expressing a pixel S' assumed on the retina (an ideal case)
Figure 11:
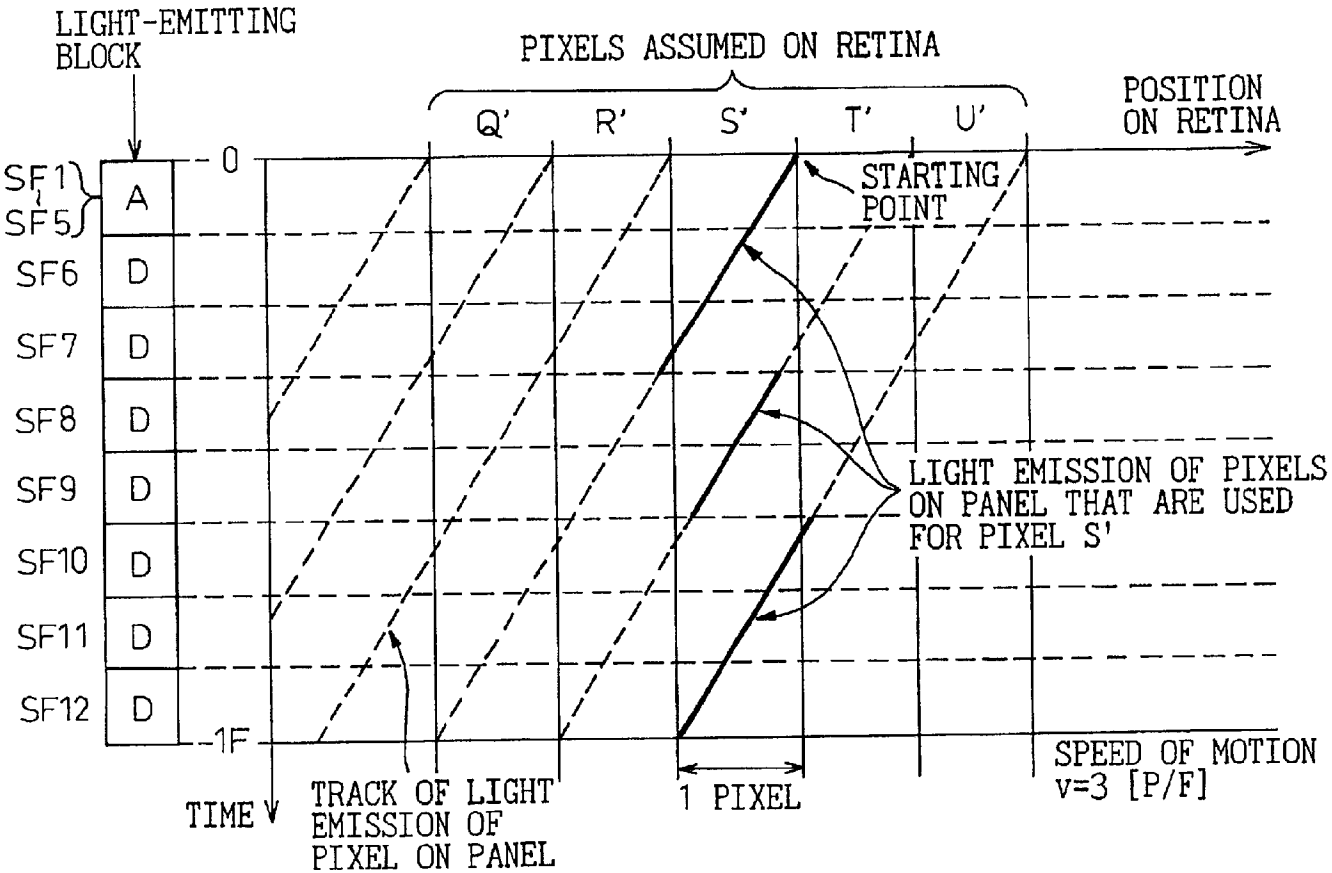
FIG. 11 is a diagram showing tracks of light emission of pixels on the panel used for expressing a pixel S' assumed on the retina (a case of considering light-emitting blocks)

FIG. 10 is a diagram showing tracks of light emission of pixels on the panel used for expressing a pixel S' assumed on the retina (an ideal case). FIG. 11 is a diagram showing tracks of light emission of pixels on the panel used for expressing a pixel S' assumed on the retina (a case of considering light-emitting blocks). FIG. 10 and FIG. 11 correspond to the above FIG. 2 and FIG. 3 respectively. These show a case when an image moves on the PDP (panel) from the left to the right direction (a speed of motion V=3 [P/F]). The light emission of the pixels Q', R', S' and T' on the retina of the observer leaves tracks as shown by broken lines in FIG. 10 on the retina, unless any processing is carried out. When the speed of motion V of an image is positive (for example, V=3 [P/F]), a starting point of the pixel S' assumed on the retina is at the right upper end of the area of the pixel S' in FIG. 10 and FIG. 11 respectively.

When the image moves in the positive direction (from the left to the right direction) on the panel, tracks are utilized for making the luminance of a pixel assumed on the retina coincide with the luminance of the input pixel, in a similar manner to that of the case where the image moves in the negative direction. For example, in the case of expressing the pixel S' assumed on the retina, light is emitted on tracks expressed by thick lines within the width of the pixel S' as shown in FIG. 10. With this arrangement, the position and the luminance on the retina coincides with the position of the input pixel. As a result, the moving picture counterfeit outline is reduced.

Referring to FIG. 11, three slanted lines (thick line parts) that constitute the pixel S' are not completely accommodated within the area of the pixel S', like the case explained with reference to FIG. 3. When it is not possible to make the luminance of the pixel on the retina completely coincide with the luminance of the input pixel because of the subframes, the light emission/non-emission is controlled in each light-emitting block in order to obtain the luminance as close to the luminance of the original pixel S as possible.

Figure 12:
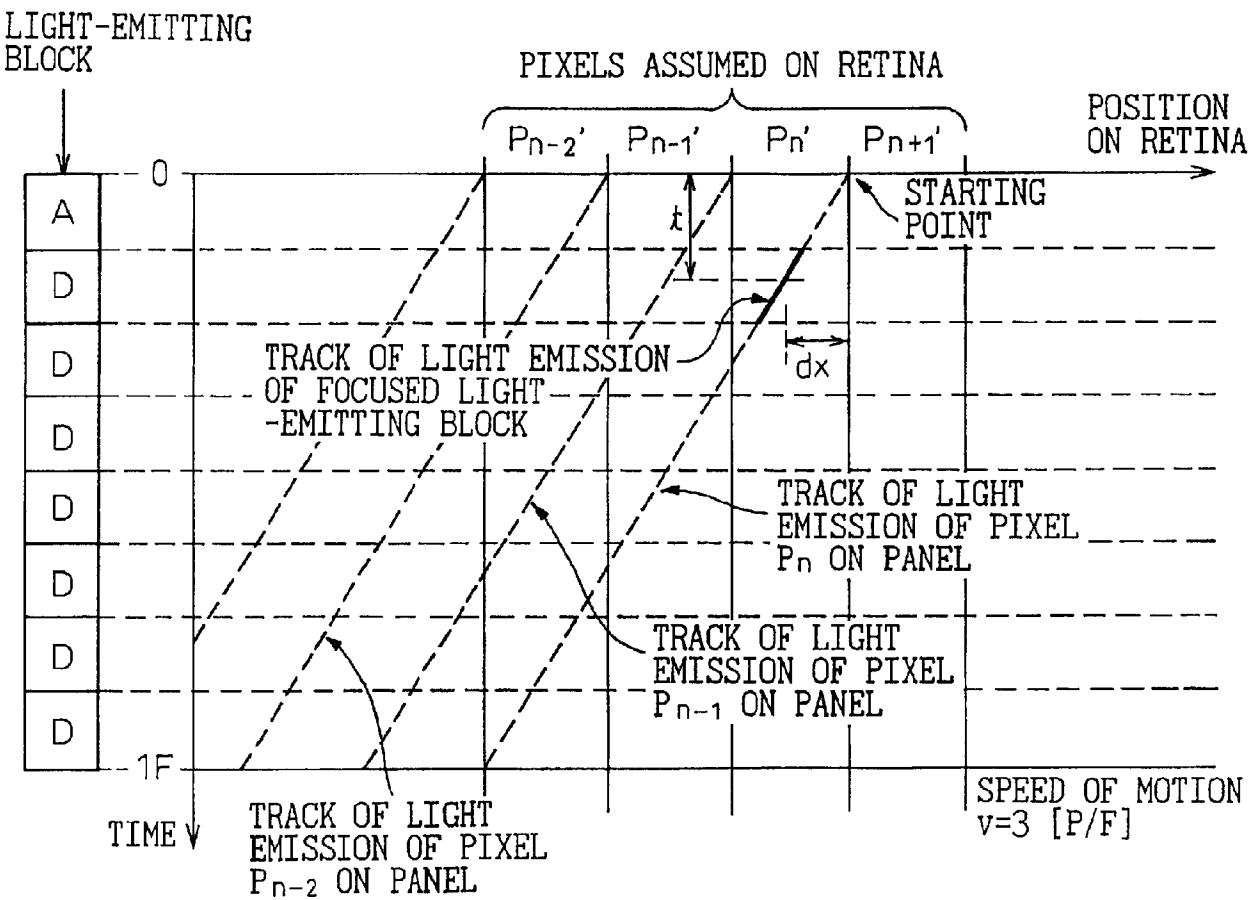
FIG. 12 is a diagram showing a time and a distance to the center of a track of a light emission of a focused light-emitting block in a pixel $P_n$ on the panel.
Figure 13:
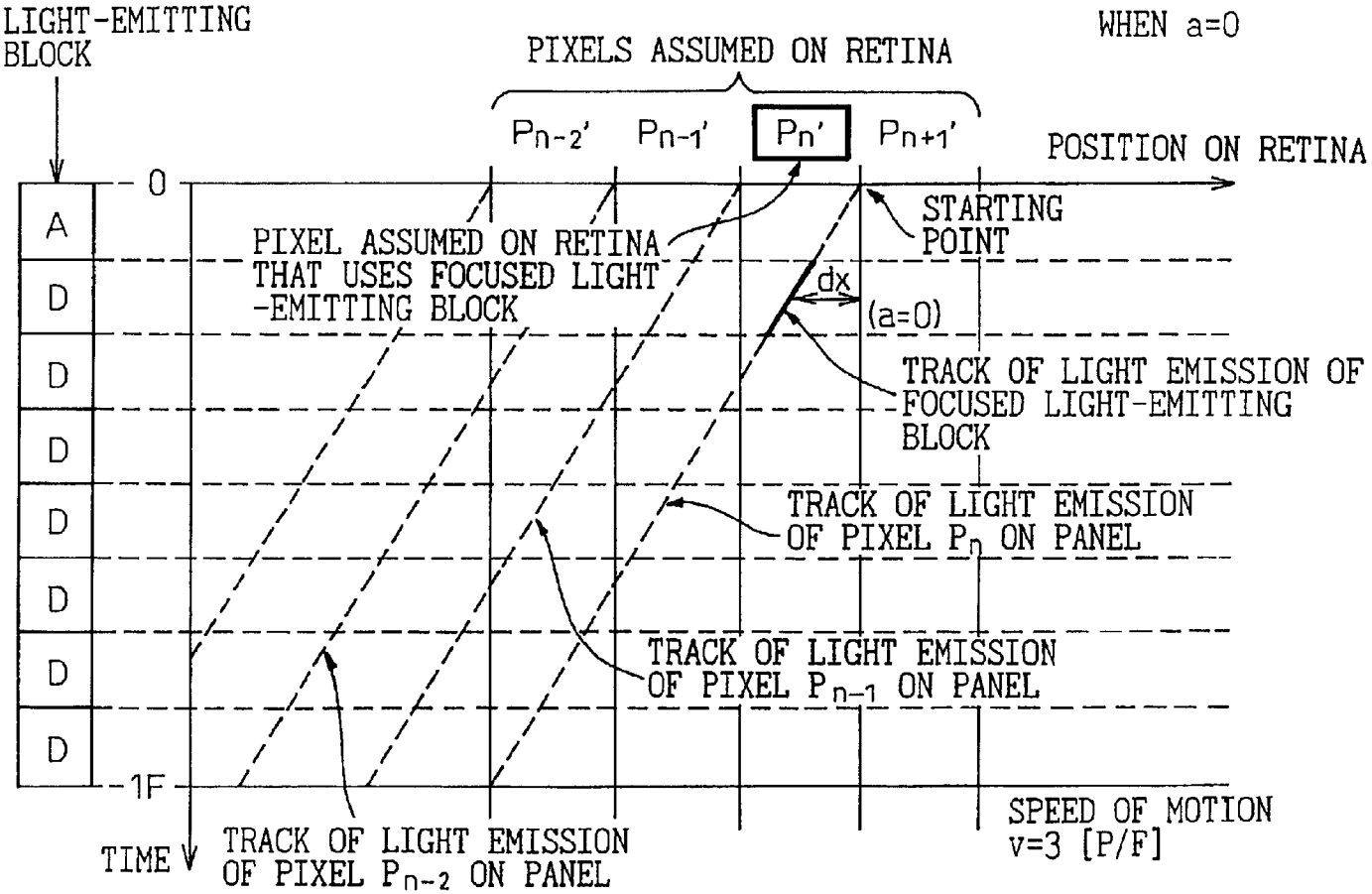
FIG. 13 is a diagram showing a case where a=0 in FIG. 12.
Figure 14:
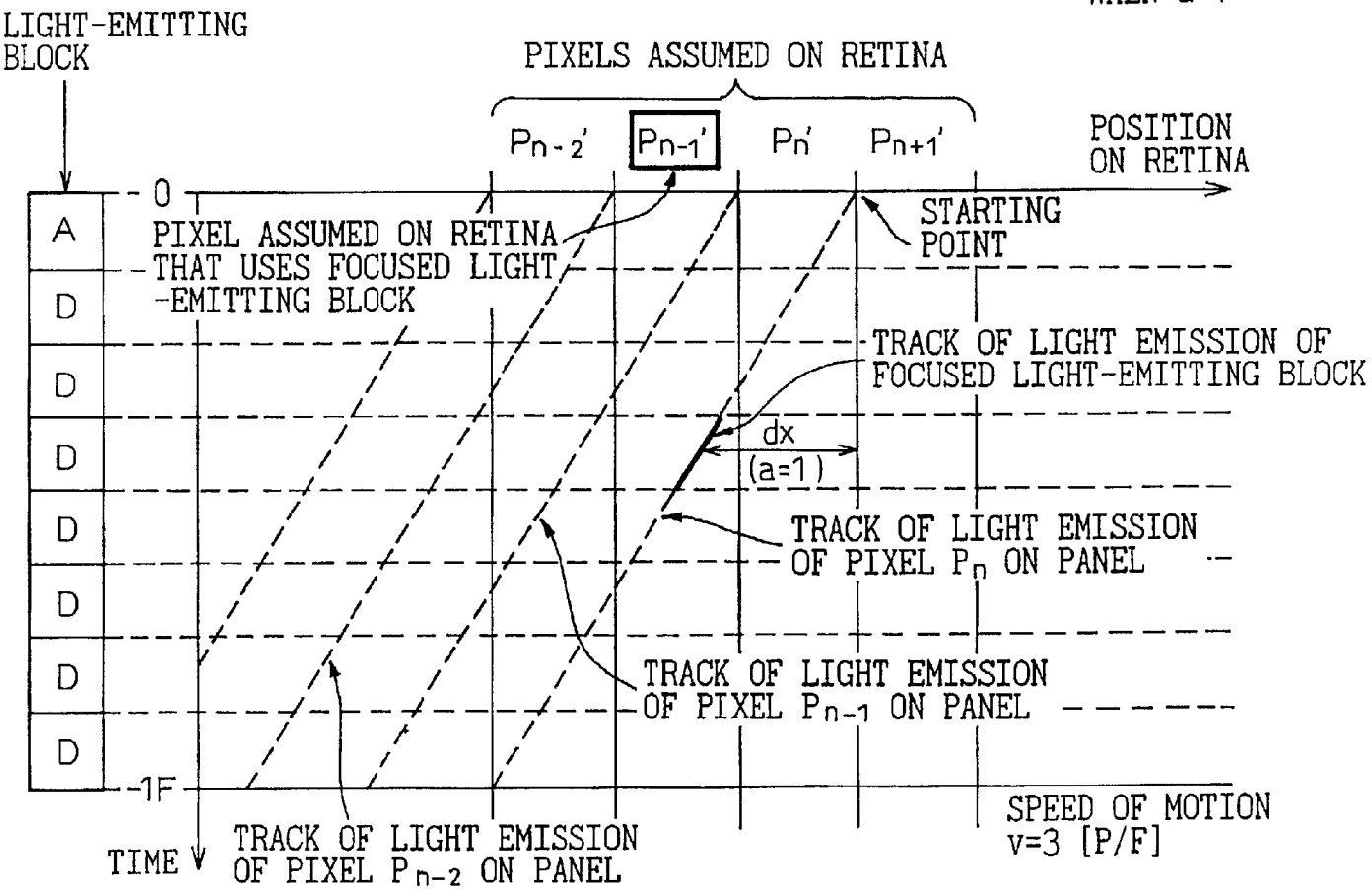
FIG. 14 is a diagram showing a case where a=1 in FIG. 12.
Figure 15:
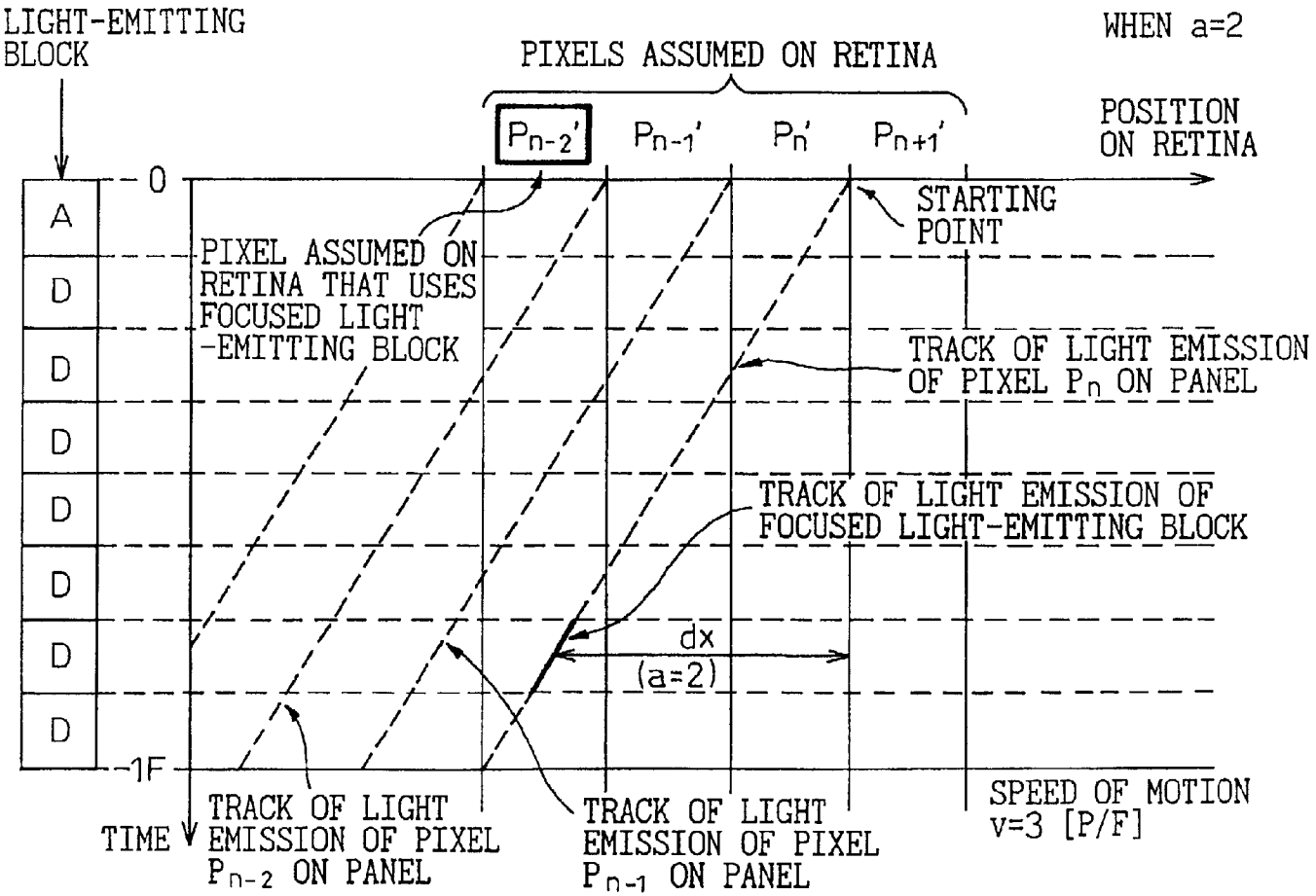
FIG. 15 is a diagram showing a case where a=2 in FIG. 12.

FIG. 12 is a diagram showing time and distance to the center of a track of a light emission of a focused light-emitting block in a pixel $P_n$ on the panel. FIG. 13 is a diagram showing a case where a=0, FIG. 14 is a diagram showing a case where a=1, and FIG. 15 is a diagram showing a case where a=2. A starting point of the pixel $P_n'$ assumed on the retina is at the right upper end of the area of the pixel $P_n'$ in each of these drawings.

FIG. 12 is a diagram corresponding to FIG. 6 explained above. This shows the principle of determining in which pixels the light-emitting blocks that constitute the pixel $P_n$ on the panel are used. First, a time t and a position dx from the starting point of the light emission of the pixel $P_n$ on the panel to the center of the light emission of the focused light-emitting block are calculated.

When an image moves on the panel from the left to the right direction (a speed of motion V=3 [P/F]) during one frame period (1F), and also when a=0, this light-emitting block is used for the pixel $P_n'$ on the retina, as shown in FIG. 13. When an image moves on the panel at a speed of motion V=3 [P/F]) during one frame period (1F), and also when a=1, this light-emitting block is used for the pixel $P_{n-1}'$ on the retina, as shown in FIG. 14. Further, when an image moves on the panel at a speed of motion V=3 [P/F]) during one frame period (1F), and also when a=2, this light-emitting block is used for the pixel $P_{n-2}'$ on the retina, as shown in FIG. 15.

Consider a case where one frame consists of twelve subframes from SF1 to SF12, as shown in FIG. 29. In this case, SF1 has a gradation level 1, SF2 has a gradation level 2, SF3 has a gradation level 4, SF4 has a gradation level 8, SF5 has a gradation level 16, and SF6 to SF12 have a gradation level 32 respectively. In this case, there are seven subframes SF6 to SF12 as light-emitting blocks (D block: redundant light-emitting block) that have equal light-emitting periods (with the gradation level 32). The A block (non-redundant light-emitting block) is a combination of SF1 to SF5, with a total gradation level 31.

When there are many patterns for selecting light-emitting blocks, the light-emitting blocks are used starting from a block positioned at the left end in order to improve resolution.

Figure 16:
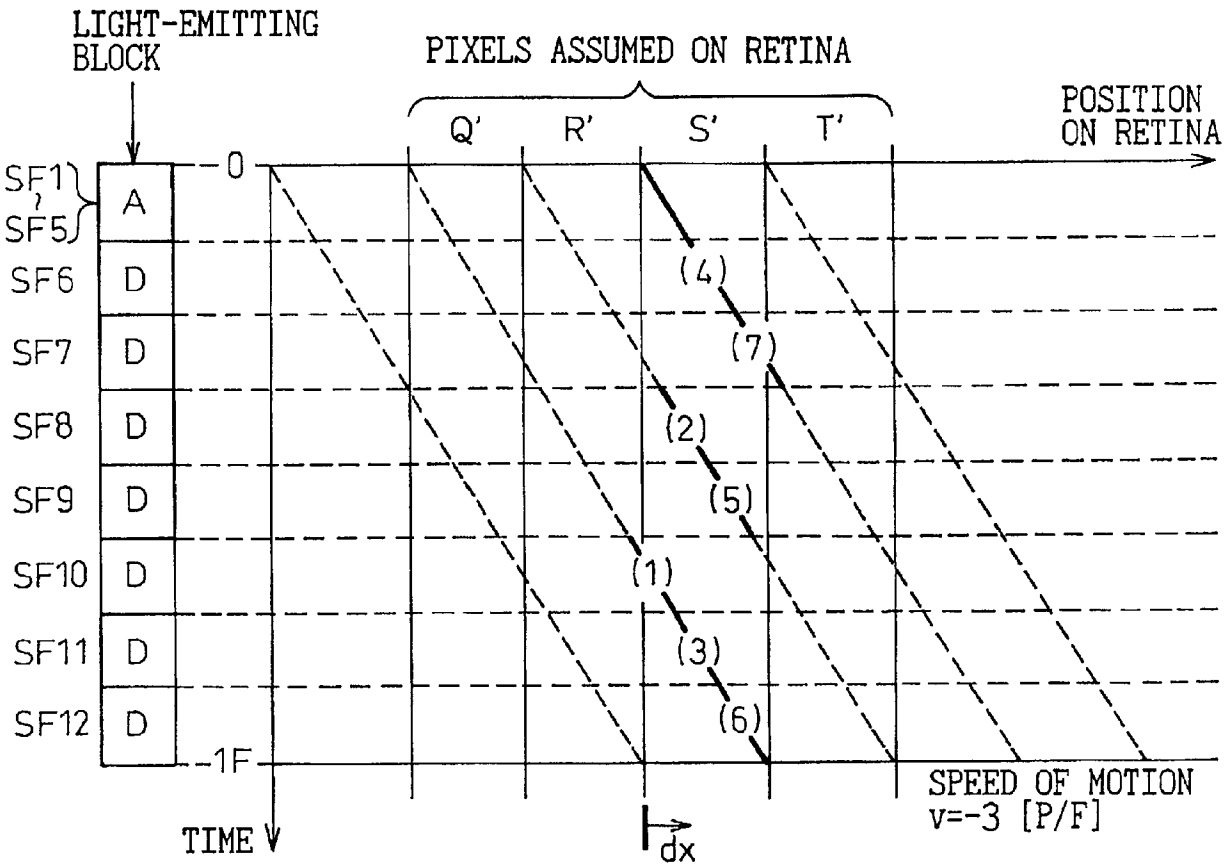
FIG. 16 is a diagram showing a sequence of selecting redundant light-emitting blocks (move in the left direction)
Figure 17:
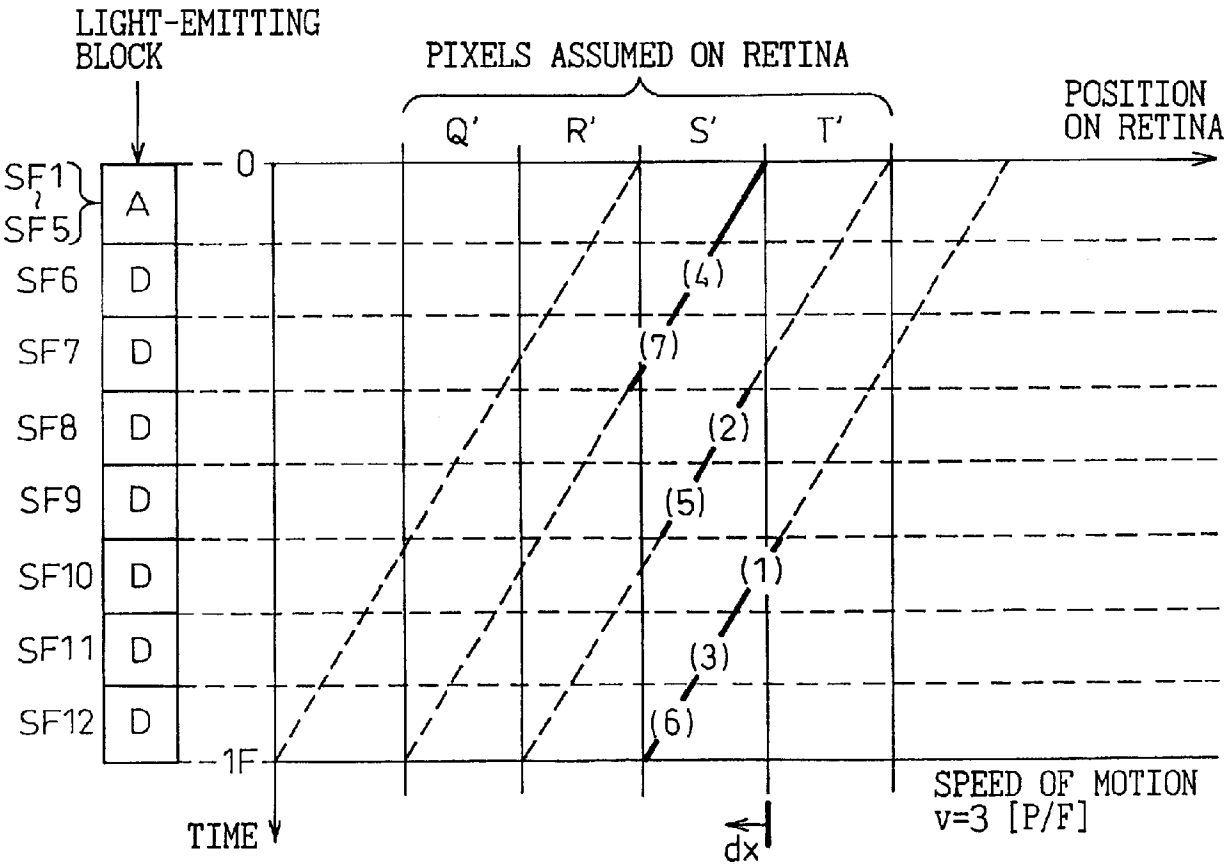
FIG. 17 is a diagram showing a sequence of selecting redundant light-emitting blocks (move in the right direction)

FIG. 16 is a diagram showing a sequence of selecting redundant light-emitting blocks (move in the left direction: V=−3 [P/F]). FIG. 17 is a diagram showing a sequence of selecting redundant light-emitting blocks (move in the right direction: V=−3 [P/F]).

As shown in FIG. 16, in the case of expressing the pixel S' on the retina, light-emitting blocks are selected in the sequence of numbers shown in parentheses with priority. In other words, redundant light-emitting blocks D are selected in the order of (1): the light-emitting block D of SF10→(2): the light-emitting block D of SF8→(3): the light-emitting block D of SF11→(4): the light-emitting block D of SF6→(5): the light-emitting block D of SF9→(6): the light-emitting block D of SF12→(7): the light-emitting block D of SF7.

This is because a distance (=dx) from the center position of each thick line part (light-emitting block) to the left end of the pixel S' is short in the order of (1)→(2)→ - - - →(7). The light-emitting block A positioned at the top is not selected because there is no other light-emitting block of the same light emission period (=redundant light-emitting block).

In the above, explanation has been made of the case where the light-emitting blocks in FIG. 16 are selected in the sequence of light-emitting blocks D having a short distance (=dx) from the center position of the light-emitting block to the left end of the pixel S', with priority. In place of the above, it is also possible to select light-emitting blocks in the sequence of light-emitting blocks D having a long distance (=dx) from the center position of the light-emitting block to the left end of the pixel S', with priority. In other words, it is possible to select light-emitting blocks in the sequence of (7)→(6)→ - - - →(1), which is opposite to the above sequence. However, when the light-emitting block A (subframes SF1 to SF5) has been used, it is preferable to select light-emitting blocks in the sequence of light-emitting blocks having a short distance from the center position of the block to the left end of the pixel S', in the order of (1)→(2)→ - - - →(7), with priority.

As explained above, it is possible to improve practical resolution by concentrating the light emission to a part of one pixel (deviating to one side), instead of dispersing the light-emitting blocks (redundant light-emitting blocks D) to the whole one pixel.

As shown in FIG. 17, in the case of expressing the pixel S' on the retina when an image moves in the direction opposite to that shown in FIG. 16, light-emitting blocks are selected in the sequence of numbers shown in parentheses with priority. In other words, redundant light-emitting blocks D are selected in the sequence of light-emitting blocks having a short distance (=dx) from the center position of the light-emitting block D to the right end of the pixel S', with priority. The light-emitting blocks D are selected in the order of (1): the light-emitting block D of SF10→(2): the light-emitting block D of SF8→(3): the light-emitting block D of SF11→(4): the light-emitting block D of SF6→(5): the light-emitting block D of SF9→(6): the light-emitting block D of SF12→(7): the light-emitting block D of SF7. In place of the above, it is also possible to select light-emitting blocks in the sequence of light-emitting blocks D having a long distance (=dx) from the center position of the light-emitting block to the right end of the pixel S', with priority. In other words, it is possible to select light-emitting blocks in the sequence of (7)→(6)→ - - - →(1). However, when the light-emitting block A (subframes SF1 to SF5) has been used, it is preferable to select light-emitting blocks in the sequence of light-emitting blocks having a short distance from the center position of the block to the right end of the pixel S', in the order of (1)→(2)→ - - - →(7), with priority. As explained above, it is possible to improve practical resolution by concentrating the light emission of the redundant light-emitting blocks D to a part of a pixel.

Figure 18:
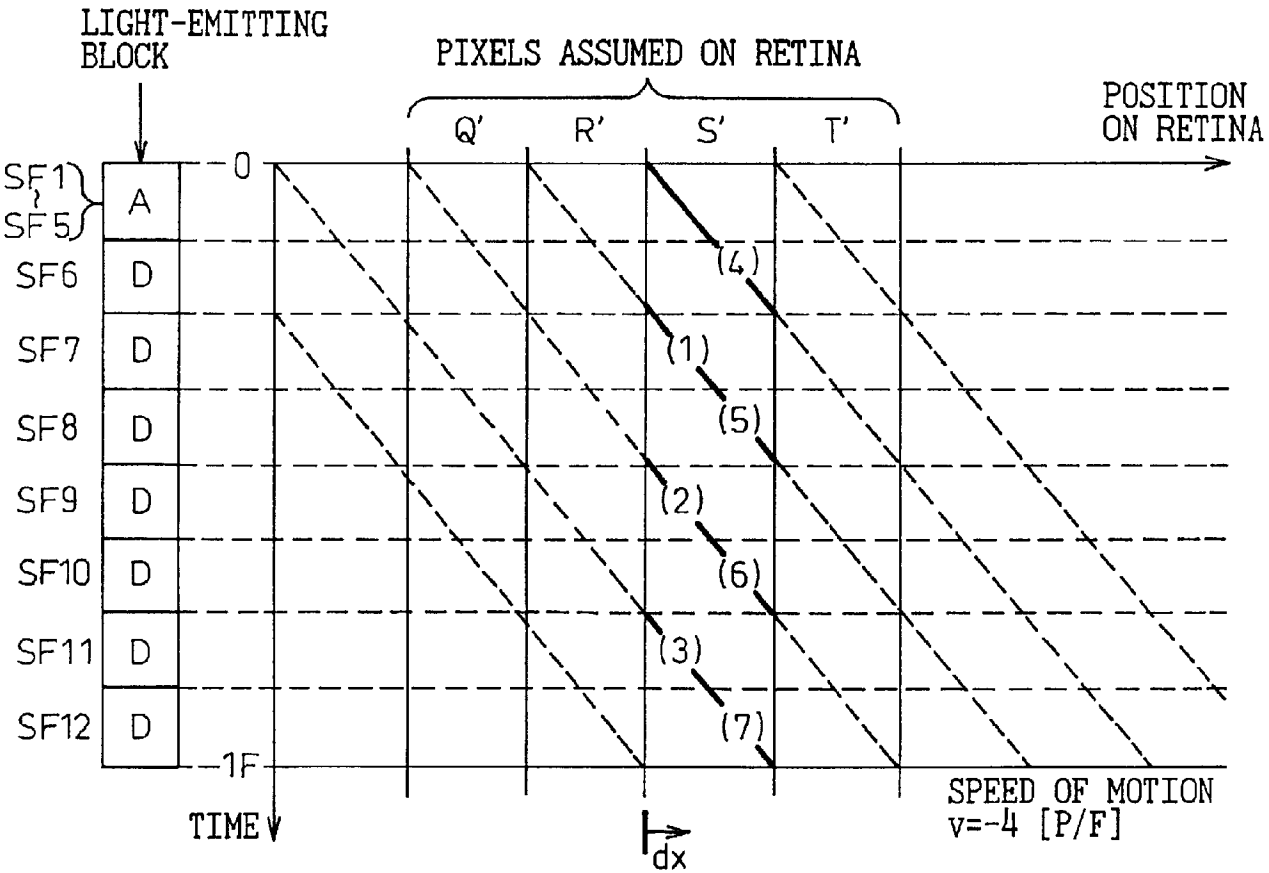
FIG. 18 is a diagram showing a sequence of selecting redundant light-emitting blocks with equal positions on the retina (move in the left direction)
Figure 19:
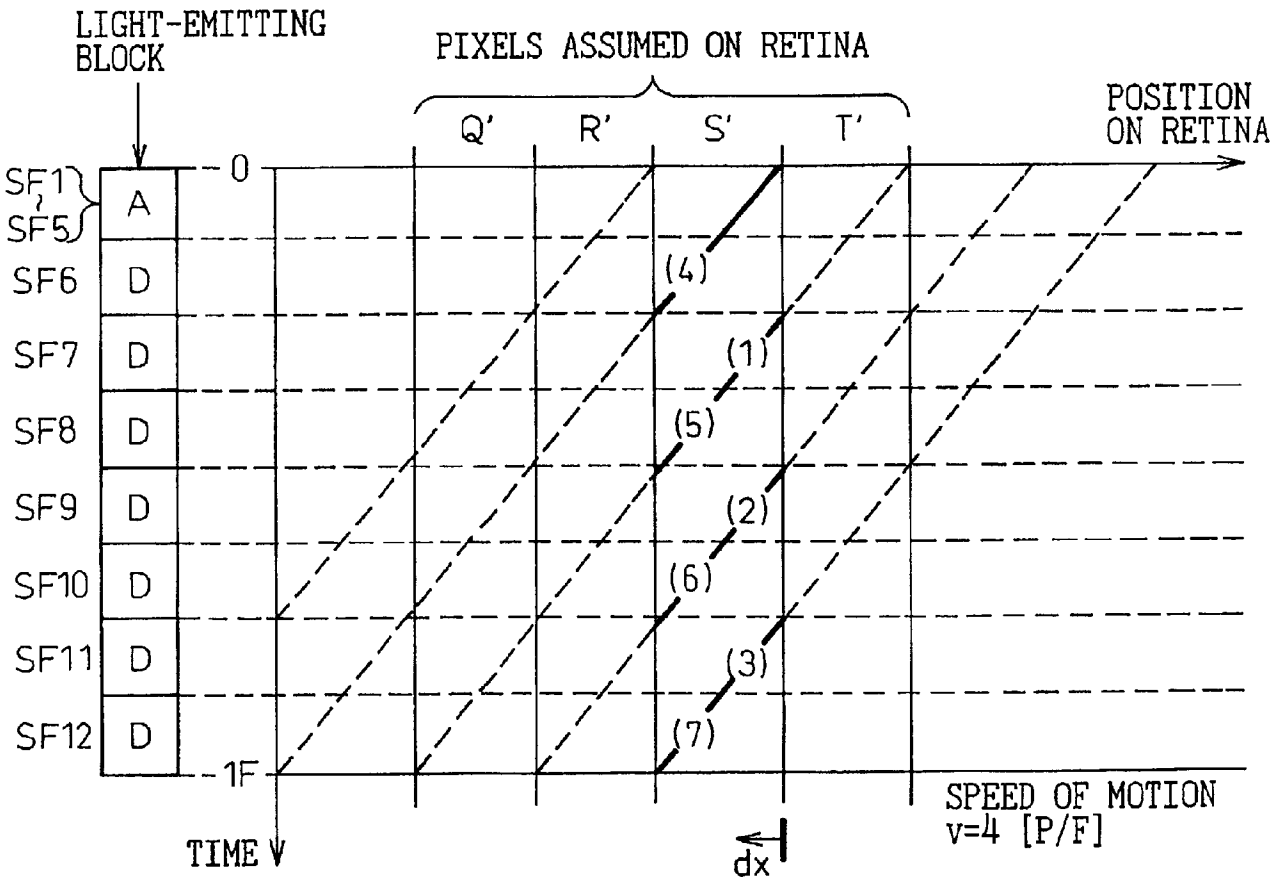
FIG. 19 is a diagram showing a sequence of selecting redundant light-emitting blocks with equal positions on the retina (move in the right direction)

FIG. 18 is a diagram showing a sequence of selecting redundant light-emitting blocks with equal positions on the retina (move in the left direction: V=−4 [P/F]). FIG. 19 is a diagram showing a sequence of selecting redundant light-emitting blocks with equal positions on the retina (move in the right direction: V=4 [P/F]).

There is a case where positions of a plurality of redundant light-emitting blocks D coincide with each other depending on a speed of motion (a case where the values of dx are equal), as shown in FIG. 18 and FIG. 19. In other words, the values of distance dx of the light-emitting blocks D of SF7, SF9 and SF11 are equal, and the values of distance dx of the light-emitting blocks D of SF6, SF8, SF10 and SF12 are equal. In this case, the light-emitting blocks D are selected in the sequence of early time. This is for preventing the occurrence of a flicker by carrying out light emission at early time. The flicker in this case refers to a flicker (a line flicker) that occurs when a light emission status is different between pixels. It is possible to restrain the occurrence of flicker by aligning the time of the light emission of large light-emitting blocks (redundant light-emitting blocks).

When the light emission of the light-emitting blocks is aligned to late time, instead of emitting light at early time, there is also similar effect of restricting the occurrence of flicker. In other words, when the values of the distance dx of redundant light-emitting blocks are equal, the light-emitting blocks may be selected in sequence starting from a light-emitting block of late time, instead of selecting light-emitting blocks in sequence starting from a light-emitting block of early time. However, when the light-emitting block A (subframes SF1 to SF5) has been used, it is preferable to carry out light emission starting from a light-emitting block of early time.

When the above-described method of driving a display device according to the present invention is applied, it is possible to obtain a higher resolution for a pixel assumed on the retina than the actual resolution of the pixel.

Figure 4A:
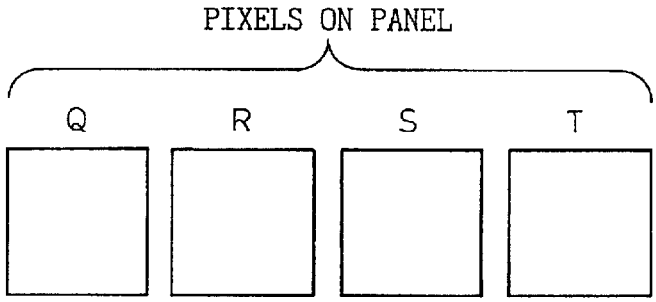
FIG. 4A and FIG. 4B are diagrams showing pixels on the panel and pixels (virtual pixels) assumed on the retina in more detail than the pixels on the panel.
Figure 4B:
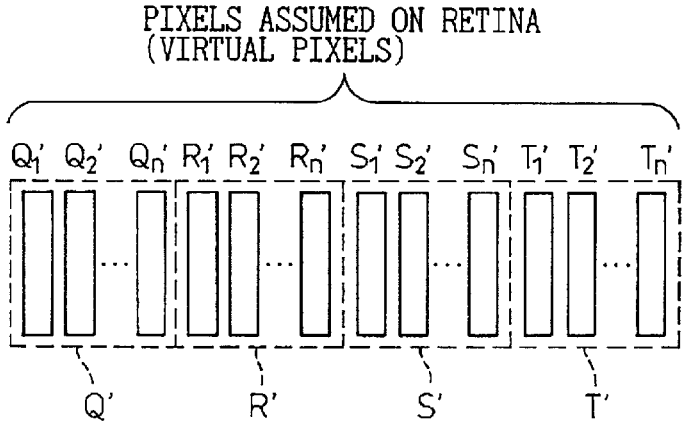
Figure 5A:
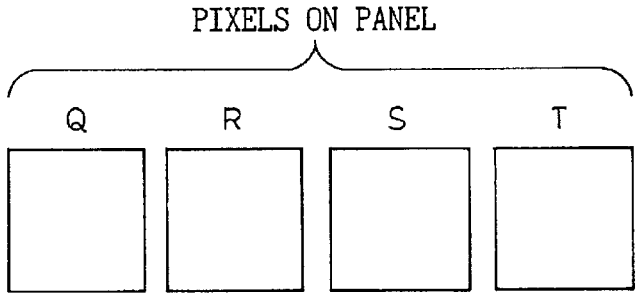
FIG. 5A and FIG. 5B are diagrams showing pixels on the panel and pixels (virtual pixels) assumed on the retina by dividing the pixels on the panel into two halves.
Figure 5B:
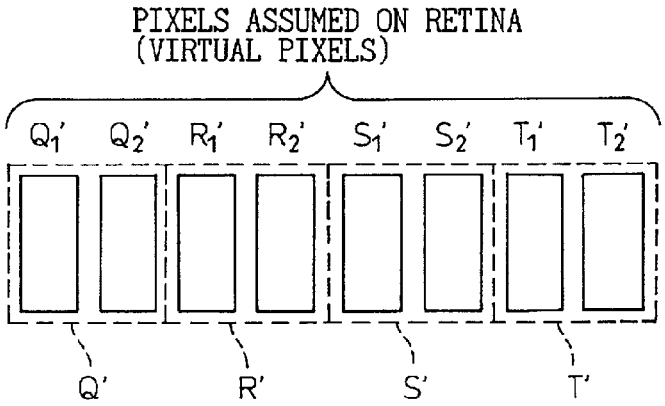

FIG. 4A and FIG. 4B are diagrams showing pixels on the panel and pixels (virtual pixels) assumed on the retina in more detail than the pixels on the panel. FIG. 5A and FIG. 5B are diagrams showing pixels on the panel and pixels (virtual pixels) assumed on the retina by dividing the pixels on the panel into two halves. FIG. 4A and FIG. 5A show pixels on the panel, and FIG. 4B and FIG. 5B show pixels assumed on the retina (virtual pixels).

As shown in FIG. 4A and FIG. 4B, when the above-described method of driving a display device according to the present invention is applied, it is possible to obtain virtual pixels Q', R', S' and T' assumed on the retina with a higher resolution (divided into 1/n) than the resolution of pixels Q, R, S and T on the panel. In other words, the virtual pixels Q', R', S' and T' assumed on the retina can be constructed of pixels $Q_1'$ to $Q_n'$, $R_1'$ to $R_n'$, $S_1'$ to $S_n'$, and $T_1'$ to $T_n'$, respectively, each pixel being divided into n pixels (n-divided virtual pixel).

The number n (a condition for high resolution) into which one virtual pixel can be divided, can be increased more when the speed of motion of an image on the panel is faster, and also when the number of redundant subframes is larger.

As shown in FIG. 5A and FIG. 5B, when the resolution of pixels Q, R, S and T on the panel is to be doubled, virtual pixels Q', R', S' and T' assumed on the retina consist of $Q_1'$ and $Q_2'$, $R_1'$ and $R_2'$, $S_1'$ and $S_2'$, and $T_1'$ and $T_2'$, respectively, each pixel being divided into two pixels. When an image moves on the panel at a speed of motion of 4 [P/F], and also when one frame consists of light-emitting blocks of A+7D (the case shown in FIG. 29), the resolution of the virtual pixels Q', R', S' and T' assumed on the retina can be doubled. Similarly, when an image moves on the panel at a speed of motion of 4 [P/F], and also when one frame consists of light-emitting blocks of A+15D, the resolution of the virtual pixels Q', R', S' and T' assumed on the retina can be increased by four times.

The intra-frame pulse-modulation system (a time-division system) as represented by the gradation display system in the PDP is characterized in that the light emission period per one TV frame of each pixel expands to a maximum one TV frame. Accordingly, when an image moves and when the viewpoint of an observer (user) traces this moving image, the light emission of this pixel expands on the retina of the observer by the pixels that move in one TV frame. When two virtual pixels are prepared within one pixel on the retina corresponding to one pixel on the panel by controlling this spreading, it is possible to double the resolution of the image in the move direction.

When the viewpoint of the observer traces the moving image, the stimulus of the light emission that the retina receives from each pixel on the panel spreads by the number of pixels over which the image moves in one TV frame. Assume that a speed of motion of an image is expressed as V [P/F, pixel/field], a light emission period of each subframe that constitutes one TV frame is expressed as t, and a number of gradations to be displayed is expressed as 256. Then, the width over which each subframe light emission period spreads on the retina becomes (Vt/255+⅓) times one pixel on the retina. The unit "pixel" used in this case refers to the width of one pixel that is composed of three sub-pixels of R, G and B on the display panel.

FIG. 4B shows a case of dividing the pixels Q', R', S' and T' assumed on the retina into n, as compared with the actual pixels (=pixels on the panel) Q, R, S and T respectively. Similarly, FIG. 5B shows a case of dividing the pixels Q', R', S' and T' assumed on the retina into two, as compared with the actual pixels (=pixels on the panel) Q, R, S and T respectively. According to an ordinary display, when there are four pixels Q, R, S and T on the panel (display panel), the same four pixels Q, R, S and T are assumed on the retina. On the other hand, when the virtual pixel technique is used, it is possible to express an image of resolution that is two times the resolution of the image on the PDP, by assuming eight virtual pixels on the retina, according to the example of FIG. 5B, for example. In other words, for the moving pictures, it is possible to assume the SXGA display (for example, 1080×1024) on the PDP that has the VGA specifications (for example, 640×480) as panel characteristics.

Figure 20:
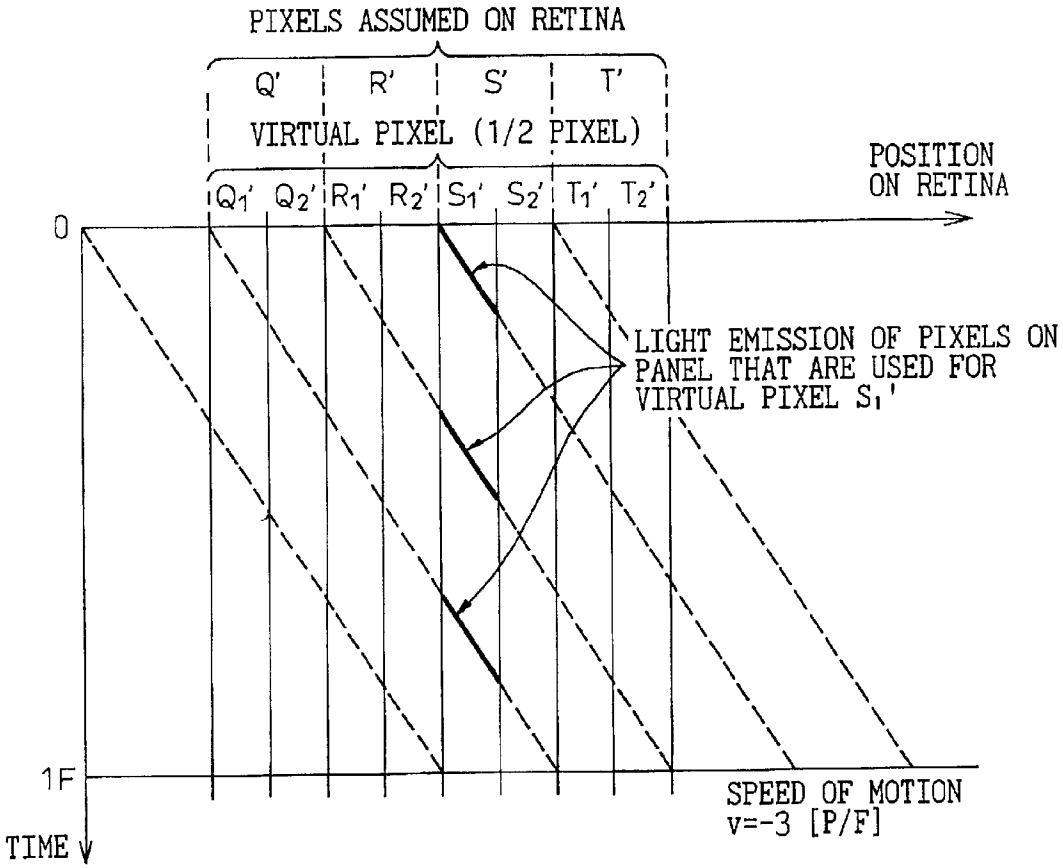
FIG. 20 is a diagram showing tracks of light emission of pixels on the panel used for expressing a virtual pixel $S_1'$ (an ideal case)
Figure 21:
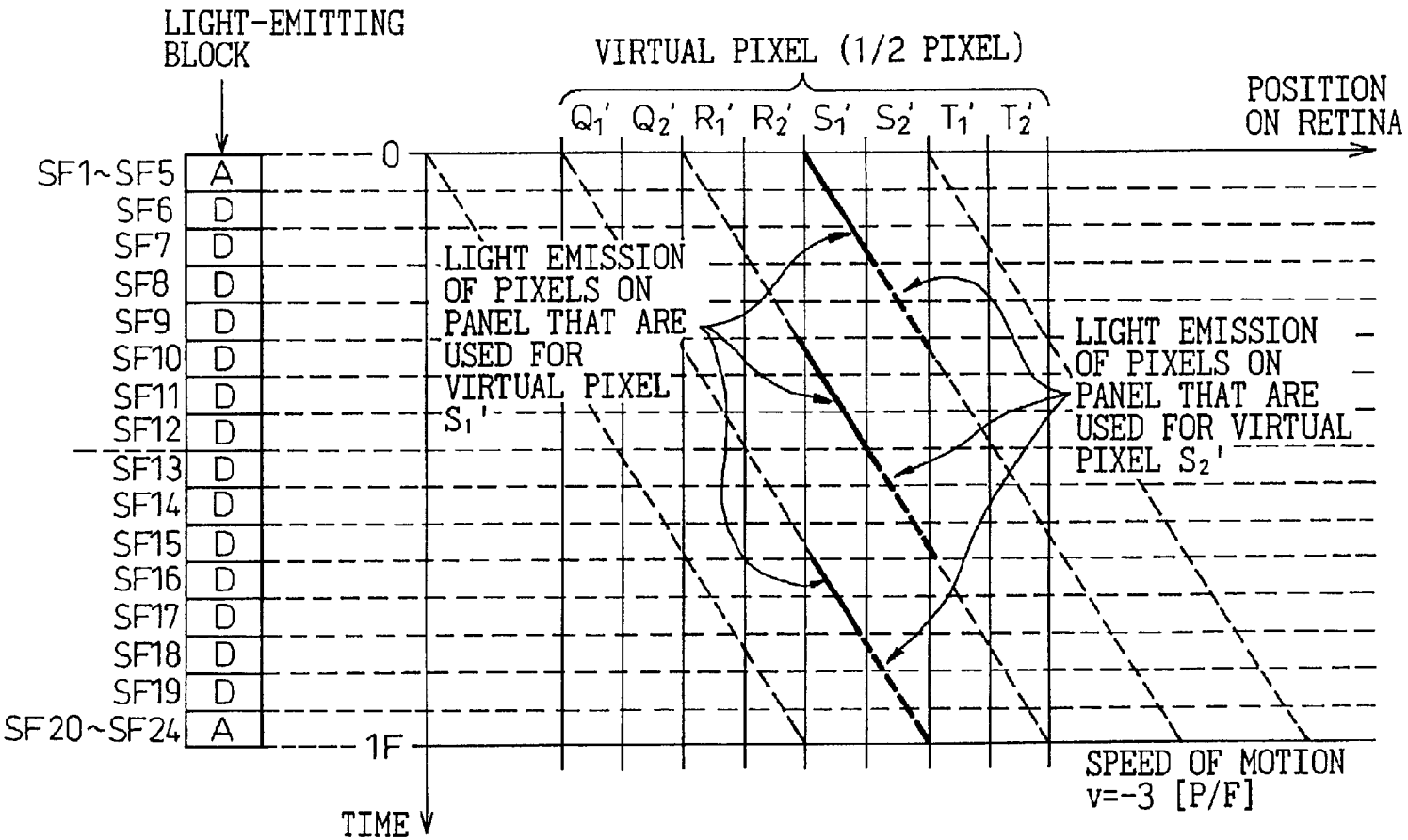
FIG. 21 is a diagram showing tracks of light emission of pixels on the panel used for expressing virtual pixels $S_1'$ and $S_2'$ (a case of considering light-emitting blocks)

FIG. 20 is a diagram showing tracks of light emission of pixels on the panel used for expressing a virtual pixel $S_1'$ (an ideal case: a case of doubling the resolution). FIG. 21 is a diagram showing tracks of light emission of pixels on the panel used for expressing virtual pixels $S_1'$ and $S_2'$ (a case of considering light-emitting blocks). FIG. 20 and FIG. 21 show pixels Q', R', S' and T' assumed on the retina of an observer when an image has moved on the panel from the right to the left direction.

In the case of forming two assumed pixels ($S_1'$ and $S_2'$) within one pixel (S') on the retina corresponding to one pixel on the panel in order to assume the pixels on the retina that are two times the number of pixels on the actual panel (display panel), ideal tracks of light emission used for forming the virtual pixel $S_1'$ become thick line parts as shown in FIG. 20.

For applying the method of driving a display device relating to the present invention, it is necessary that an image is moving on the panel and that a direction of the motion and speed are known in advance.

Figure 24:
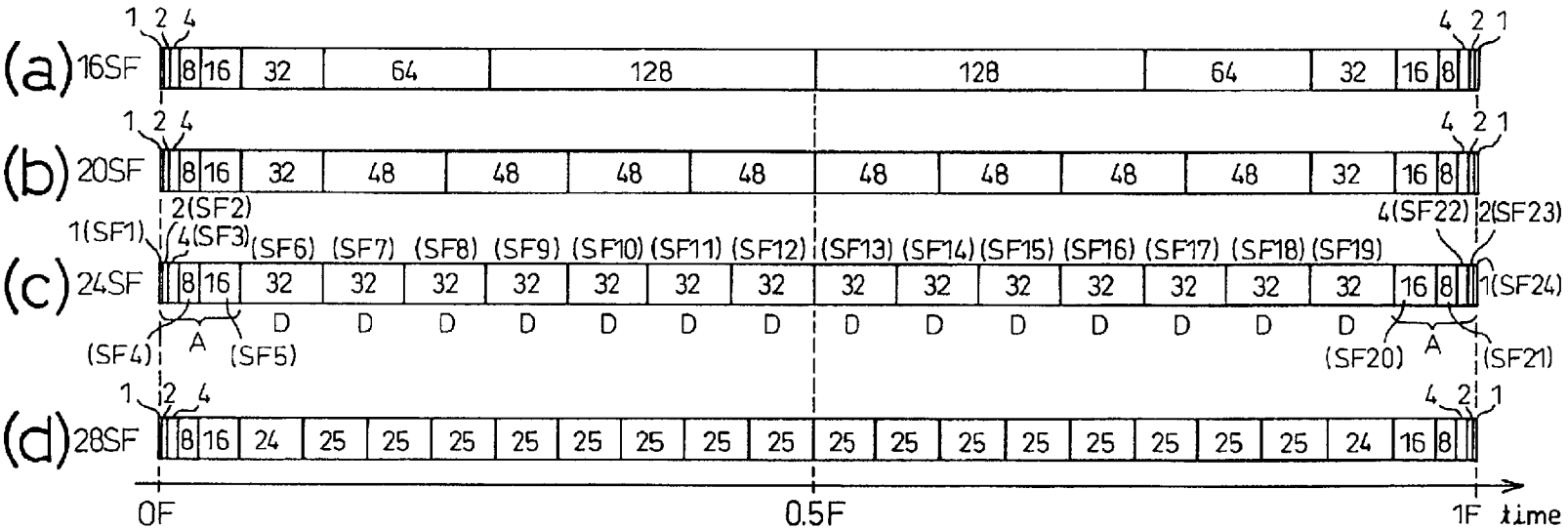
FIG. 24 is a diagram showing an example of arrays of subframes used in the method (virtual pixel technique) for driving a display device relating to the present invention.

FIG. 24 is a diagram showing an example of arrays of subframes used in the method (virtual pixel technique) for driving a display device relating to the present invention.

FIG. 24(*c*) shows a case where two sets of one frame, each consisting of twelve subframes from SF1 to SF12, shown in FIG. 29 are provided. In other words, twenty-four subframes in total are provided symmetrically, twelve subframes from SF1 to SF 12 for 0F to 0.5F, and twelve subframes from SF24 to SF 13 for 0.5 F to 1F. FIG. 24(*a*) shows a case where sixteen subframes (light-emitting blocks) having no redundant blocks are arrayed symmetrically around 0.5F. FIG. 24(*b*) shows a case where twenty subframes having four redundant blocks are arrayed symmetrically around 0.5F. FIG. 24(*d*) shows a case where twenty-eight subframes having eight (nine) redundant blocks are arrayed symmetrically around 0.5F.

When one frame consists of twenty-four subframes from SF1 to SF24 as shown in FIG. 24(*c*), light-emitting blocks to be selected are as shown in FIG. 21.

As one example, consider a case where an image moves from the right to the left direction (V=−3 [P/F]) using 24 SFs as shown in FIG. 24(*c*). In FIG. 21, slanted broken lines show tracks of light emission of pixels Q, S, R and T of the same color on the panel. Based on the move of the image and the trace of the viewpoint, the light emission period of each subframe is dispersed on the retina. It is possible to double the resolution when data for two pixels are disposed within the width of one pixel on the retina by controlling the light emitting position. When the light-emitting blocks expressed by solid thick line parts on the left-half side of thick lines are selected, the stimulus of the light emission received on the retina becomes a pixel (one-half pixel) $S_1'$. When the light-emitting blocks expressed by broken thick line parts on the right-half side of thick lines are selected, the stimulus of the light emission received on the retina becomes a pixel (one-half pixel) $S_2'$. As a result, it is possible to control the pixels each in the width of one half of the width of the original one virtual pixel (Q') on the retina.

The left half and the right half portions of each thick line include one light-emitting block of A (a set of the subframes SF1 to SF5 and a set of subframes SF20 to SF24, respectively) and seven light-emitting blocks of D (SF6 to SF1, and SF13 to SF19, respectively). Therefore, it is possible to express 256 gradations in each subframe using the pixels $S_1'$ and $S_2'$ based on the above combination.

As explained above, based on the use of the virtual pixel technique according to the present invention, it is possible to double the resolution of the pixels assumed on the retina as $Q_1'$ and $Q_2'$, $R_1'$ and $R_2'$, $S_1'$ and $S_2'$, and $T_1'$ and $T_2'$, for the actual pixels on the panel of Q, R, S and T respectively. However, the luminance between pixels is not zero, and the luminance is superimposed with the other.

Figure 22:
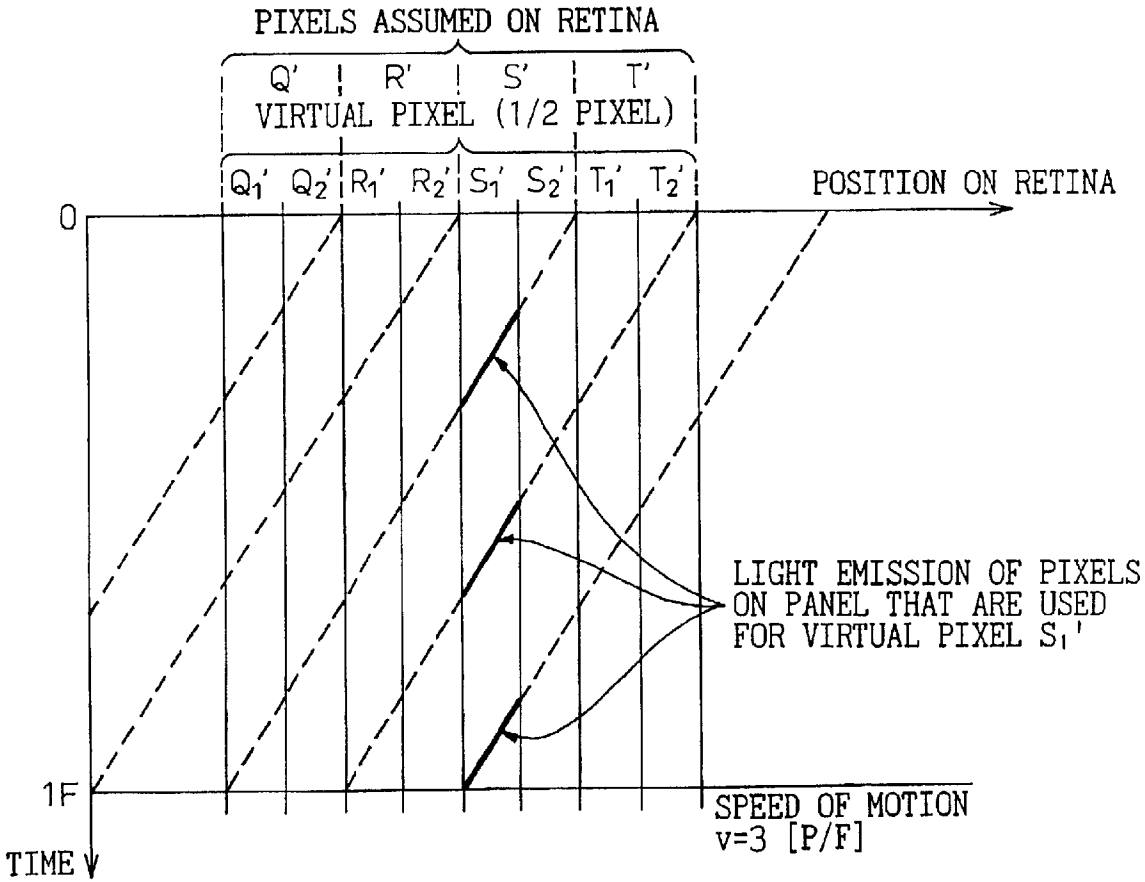
FIG. 22 is a diagram showing tracks of light emission of pixels on the panel used for expressing a virtual pixel $S_1'$ (an ideal case)
Figure 23:
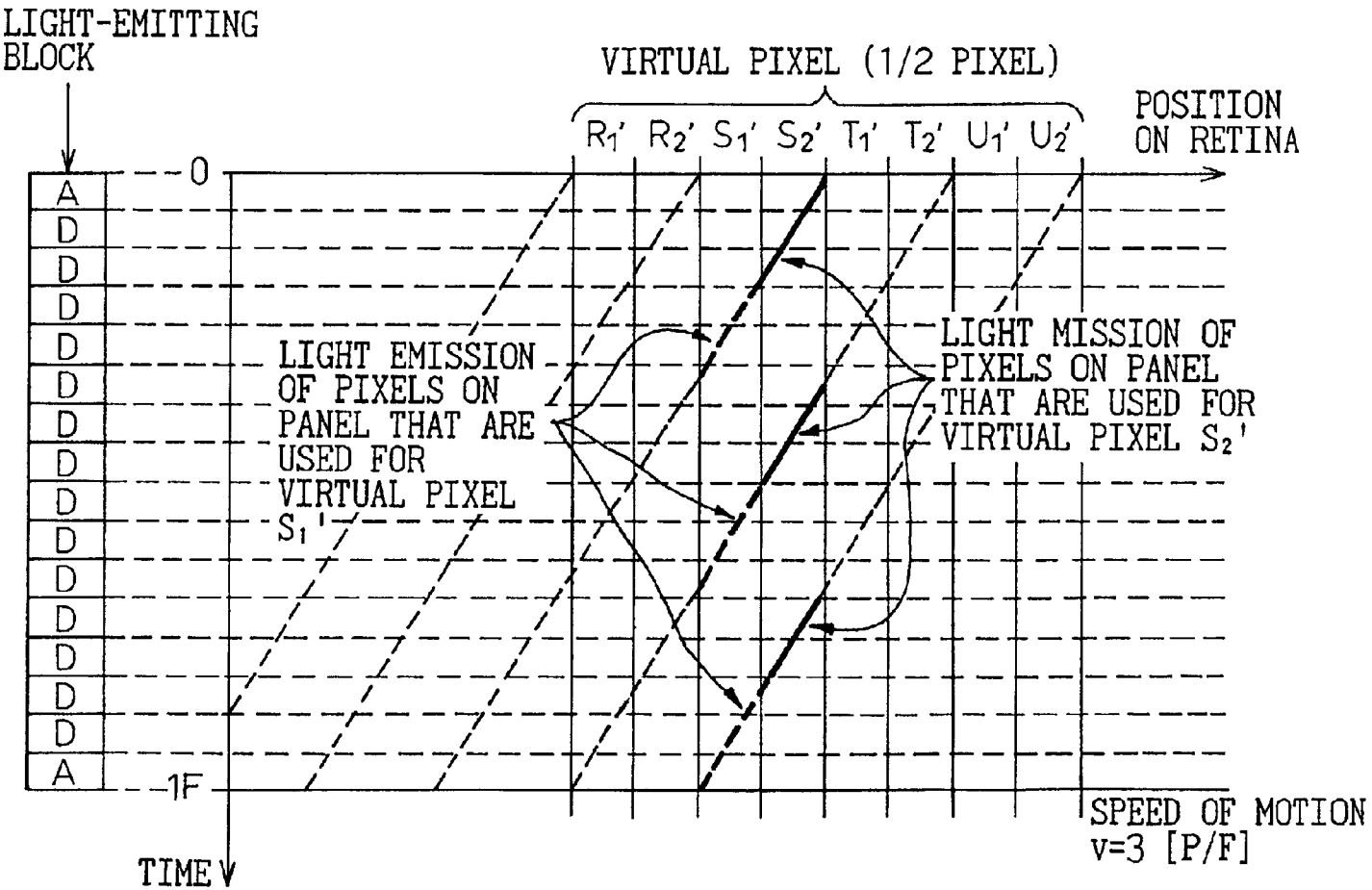
FIG. 23 is a diagram showing tracks of light emission of pixels on the panel used for expressing virtual pixels $S_1'$ and $S_2'$ (a case of considering light-emitting blocks)

FIG. 22 is a diagram showing tracks of light emission of pixels on the panel used for expressing a virtual pixel $S_1'$ (an ideal case: a case of doubling the resolution). FIG. 23 is a diagram showing tracks of light emission of pixels on the panel used for expressing virtual pixels $S_1'$ and $S_2'$ (a case of considering light-emitting blocks). FIG. 22 and FIG. 23 show pixels Q', R', S' and T' assumed on the retina of an observer when an image has moved on the panel from the left to the right direction. FIG. 22 and FIG. 23 are also similar to FIG. 20 and FIG. 21 in which an image has moved on the panel from the right to the left direction.

As described above, the arrays of subframes (light-emitting block arrays) shown in FIG. 24(*a*) to FIG. 24(*d*) are symmetrical around 0.5F. In order to display 256 gradations for each one-half pixel on the retina, two sets of subframes, each including 256 gradations, are prepared within one frame (one TV frame). When virtual pixels, each one pixel divided into two pixels, are used, it is possible to select light-emitting patterns symmetrically for each pixel. Therefore, this arrangement is effective for determining light-emitting blocks to be used. It is in principle preferable to increase the number of subframes (SFs) for constituting one frame. When there is redundancy in the selection of light-emitting blocks, it is preferable to select light-emitting blocks in the manner similar to that explained with reference to FIG. 16 to FIG. 19. In other words, it is preferable to select light-emitting blocks starting from a light-emitting block positioned at the end of a pixel (one-half pixel $S_1'$, $S_2'$, etc.) when it is possible to select based on space, with priority. When it is possible to select based on time, it is preferable to select light-emitting blocks starting from a light-emitting block of early time (or late time), with priority.

Figure 25:
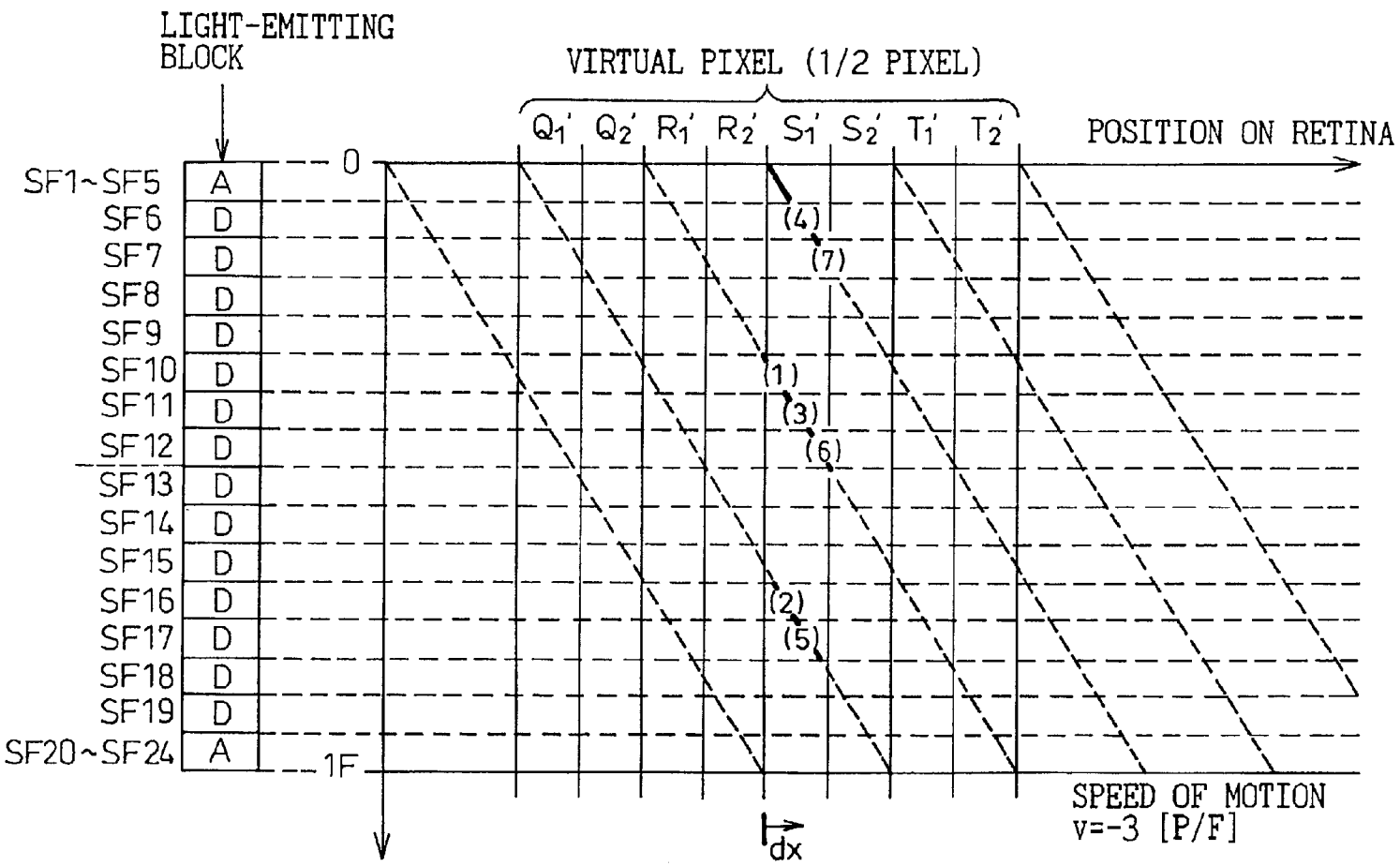
FIG. 25 is a diagram for explaining one example of a sequence of selecting redundant light-emitting blocks in a virtual pixel $S_1'$ (move in the left direction)
Figure 26:
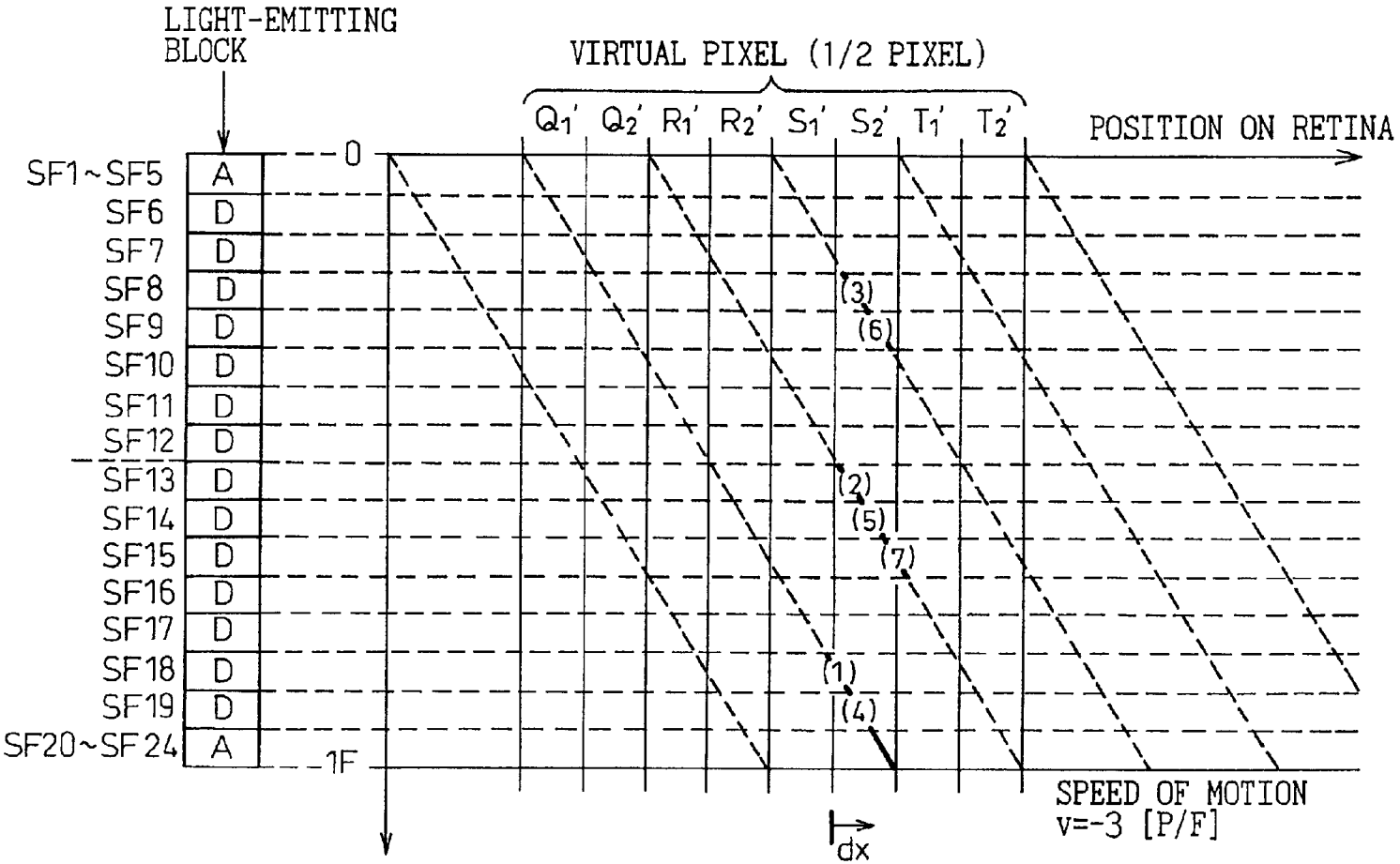
FIG. 26 is a diagram for explaining one example of a sequence of selecting redundant light-emitting blocks in a virtual pixel $S_2'$ (move in the left direction)

FIG. 25 is a diagram for explaining one example of a sequence of selecting redundant light-emitting blocks in a virtual pixel $S_1'$ (move in the left direction). FIG. 26 is a diagram for explaining one example of a sequence of selecting redundant light-emitting blocks in a virtual pixel $S_2'$ (move in the left direction). FIG. 25 and FIG. 26 correspond to FIG. 16 respectively.

As shown in FIG. 25, in the case of expressing a one-half pixel $S_1'$ on the retina, for example, light-emitting blocks are selected in the sequence of blocks having a short distance (=dx) from the center position of a thick line part (light-emitting block) to the left end of the pixel $S_1'$, with priority. The light-emitting blocks D are selected in the order of numbers in parentheses, with preference, that is, (1): the light-emitting block D of SF10→(2): the light-emitting block D of SF16→(3): the light-emitting block D of SF11→(4): the light-emitting block D of SF6→(5): the light-emitting block D of SF17→(6): the light-emitting block D of SF12→(7): the light-emitting block D of SF7.

As shown in FIG. 26, in the case of expressing a one-half pixel $S_2'$ on the retina, for example, light-emitting blocks are selected in the sequence of blocks having a short distance (=dx) from the center position of a thick line part (light-emitting block) to the left end of the pixel $S_2'$, with priority. The light-emitting blocks D are selected in the order of (1): the light-emitting block D of SF18→(2): the light-emitting block D of SF13→(3): the light-emitting block D of SF8→(4): the light-emitting block D of SF19→(5): the light-emitting block D of SF14→(6): the light-emitting block D of SF9→(7): the light-emitting block D of SF15.

In the above, description has been made of the case where light-emitting blocks are selected in the sequence of blocks having a short distance (=dx) from the center position of a light-emitting block D to the left end of the pixel $S_1'$ ($S_2'$), with priority, in FIG. 25 (FIG. 26). It is also possible to select light-emitting blocks in the sequence of blocks having a long distance (=dx) from the center position of a light-emitting block D to the left end of the pixel $S_1'$ ($S_2'$), with priority. In other words, it is also possible to select light-emitting blocks in the sequence of blocks having a short distance (=dx) from the center position of a light-emitting block D to the right end of the pixel $S_1'$ ($S_2'$), with priority.

Figure 27:
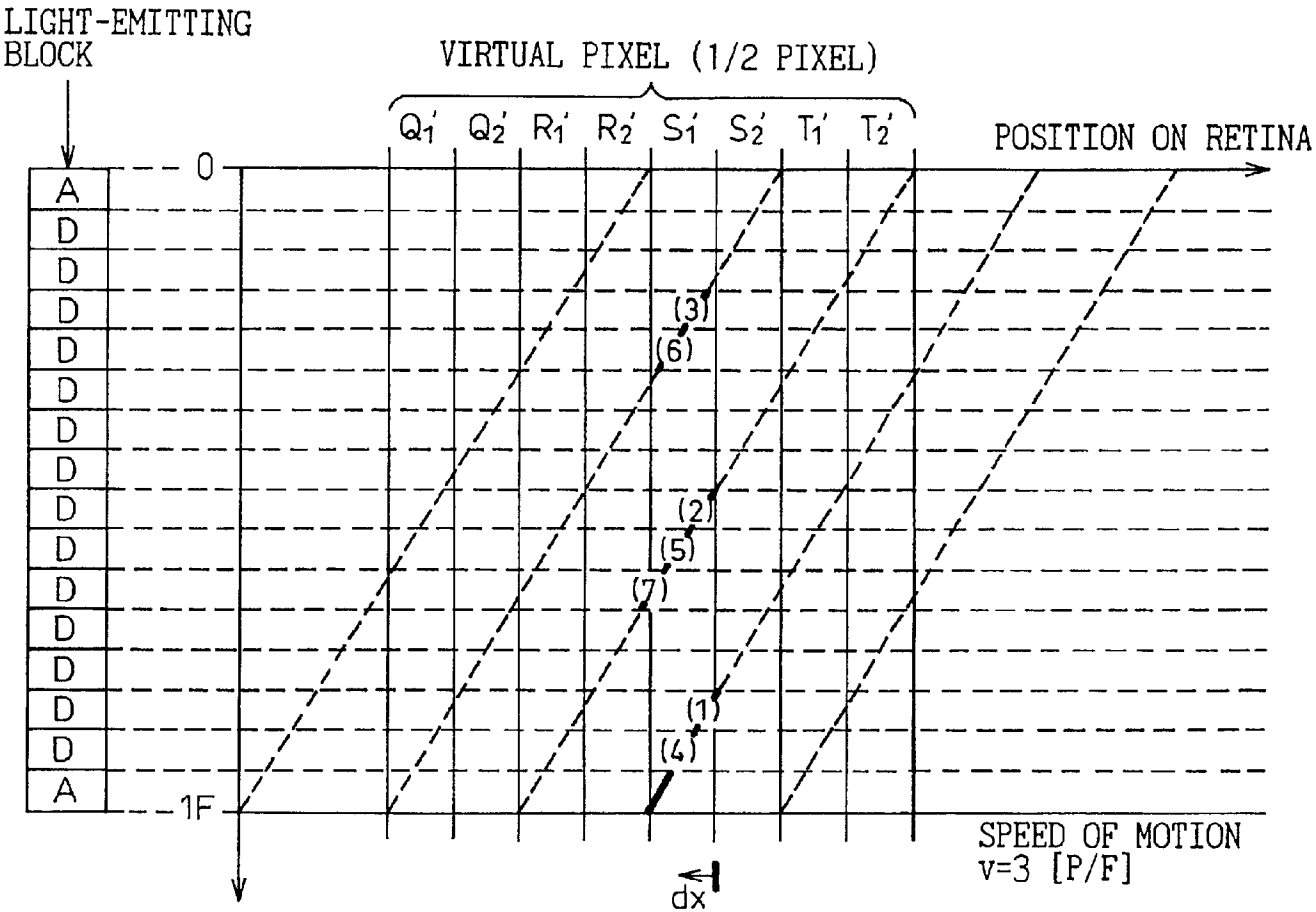
FIG. 27 is a diagram for explaining one example of a sequence of selecting redundant light-emitting blocks in a virtual pixel $S_1'$ (move in the right direction)
Figure 28:
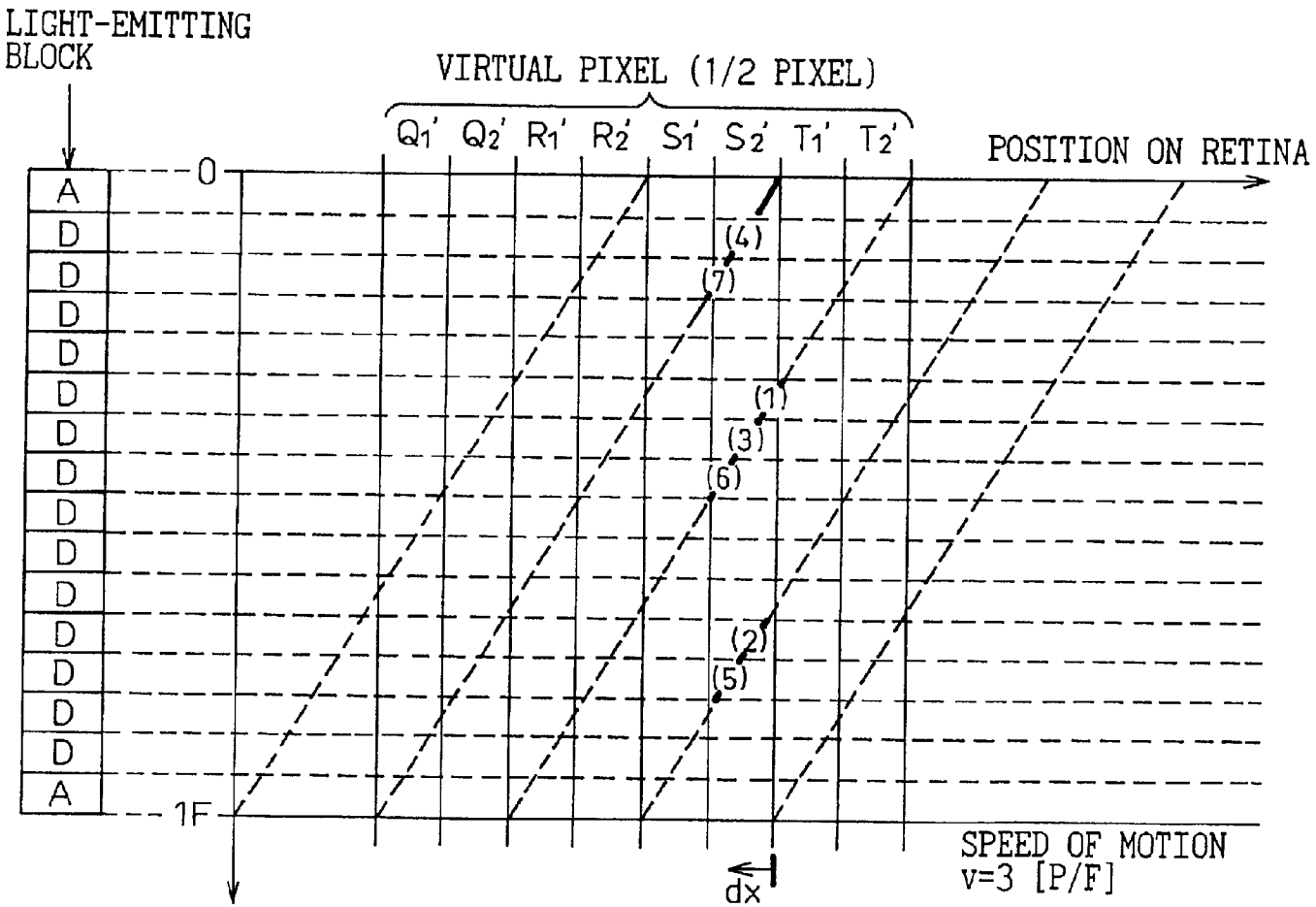
FIG. 28 is a diagram for explaining one example of a sequence of selecting redundant light-emitting blocks in a virtual pixel $S_2'$ (move in the right direction)

FIG. 27 is a diagram for explaining one example of a sequence of selecting redundant light-emitting blocks in a virtual pixel $S_1'$ (move in the right direction). FIG. 28 is a diagram for explaining one example of a sequence of selecting redundant light-emitting blocks in a virtual pixel $S_2'$ (move in the right direction). FIG. 27 and FIG. 28 correspond to FIG. 17 respectively.

As shown in FIG. 27 and FIG. 28, when an image moves in an opposite direction to that shown in FIG. 25 and FIG. 26, light-emitting blocks are selected in the sequence of blocks having a short distance (=dx) from the center position of a light-emitting block D to the right end of a one-half pixel $S_1'$ or $S_2'$ on the retina, with priority.

Figure 35:
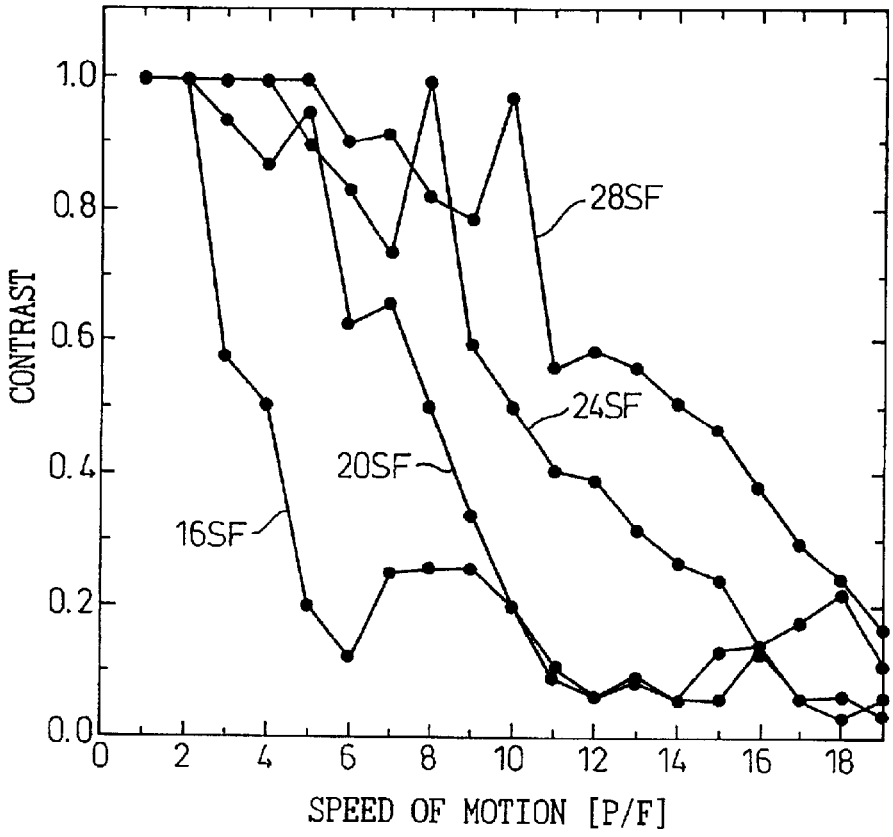
FIG. 35 is a diagram showing a relationship between speed of motion and contrast of an image on a display panel.

FIG. 35 is a diagram showing a relationship between speed of motion and contrast of an image on a display panel. The virtual pixel technique (the method of driving a display device) relating to the present invention has been applied to the arrays of the four kinds of subframes shown in FIG. 24(*a*) to FIG. 24(*d*). FIG. 35 shows a result of calculating a contrast $(B_{max}-B_{min})/(B_{max}+B_{min})$ of a striped pattern of gradation levels 0-255-0-255 expressed in relation to a speed of motion from 1 [P/F] to 19 [P/F], using the resolution of the SXGA (the number of horizontal pixels: 1280) that is two times the resolution VGA (the number of horizontal pixels: 640) of the display panel.

As is apparent from FIG. 35, as the speed of motion of the image on the panel increases, the contrast is lowered. This is because the positional spread of the subframe light emission becomes large in proportion to the speed of motion.

Figure 36:
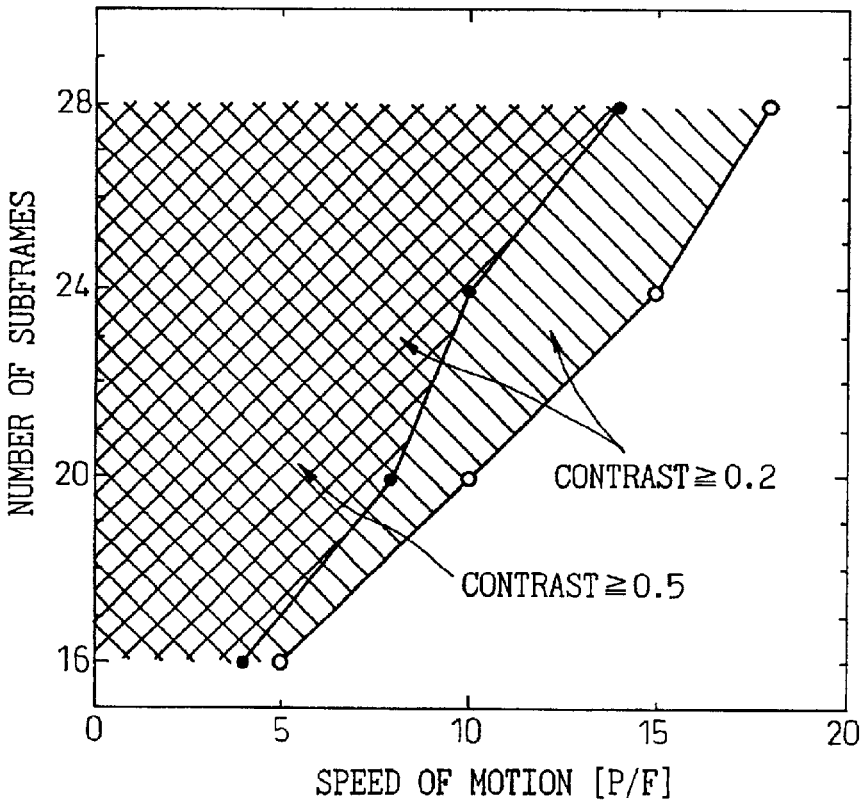
FIG. 36 is a diagram showing a relationship between speed of motion and the number of subframes of an image on a display panel.

FIG. 36 is a diagram showing a relationship between speed of motion and the number of subframes of an image on a display panel. This shows a range of speed of motion of an image having a contrast of 0.2 or above and 0.5 or above in relation to the array of each subframe respectively.

According to a general television signal, the appearance frequency of a moving picture decreases along the increase in the speed of motion. For example, the appearance frequency of an image of 10 [P/F] is about ten percent of the appearance frequency of 1 [P/F].

It is clear from FIG. 36 that 24 or more SFs are necessary in order to express the contrast of 0.5 or above at a speed between 1 [P/F] and 10 [P/F]. The spread of light emission depends on a subframe that has a longest light emission period among subframes that constitute one TV frame. Therefore, in order to obtain sufficient effect of resolution, it is preferable that this is as short as possible.

When an input image has the resolution of the SXGA and the panel (PDP) for displaying the image has the resolution of the VGA, according to the ordinary system, the image is displayed on the PDP after the image conversion from the SXGA to the VGA. As a result, a visually observed image becomes the resolution of the VGA. On the other hand, when the virtual pixel technique relating to the present invention is used, it is possible to input the image data of the SXGA straight in the direction of the motion. While the PDP used for the display has the resolution of the VGA, the image that is visually observed has the resolution of the SXGA in the direction of the motion of the image.

Figures 37A, 37B, 37C:
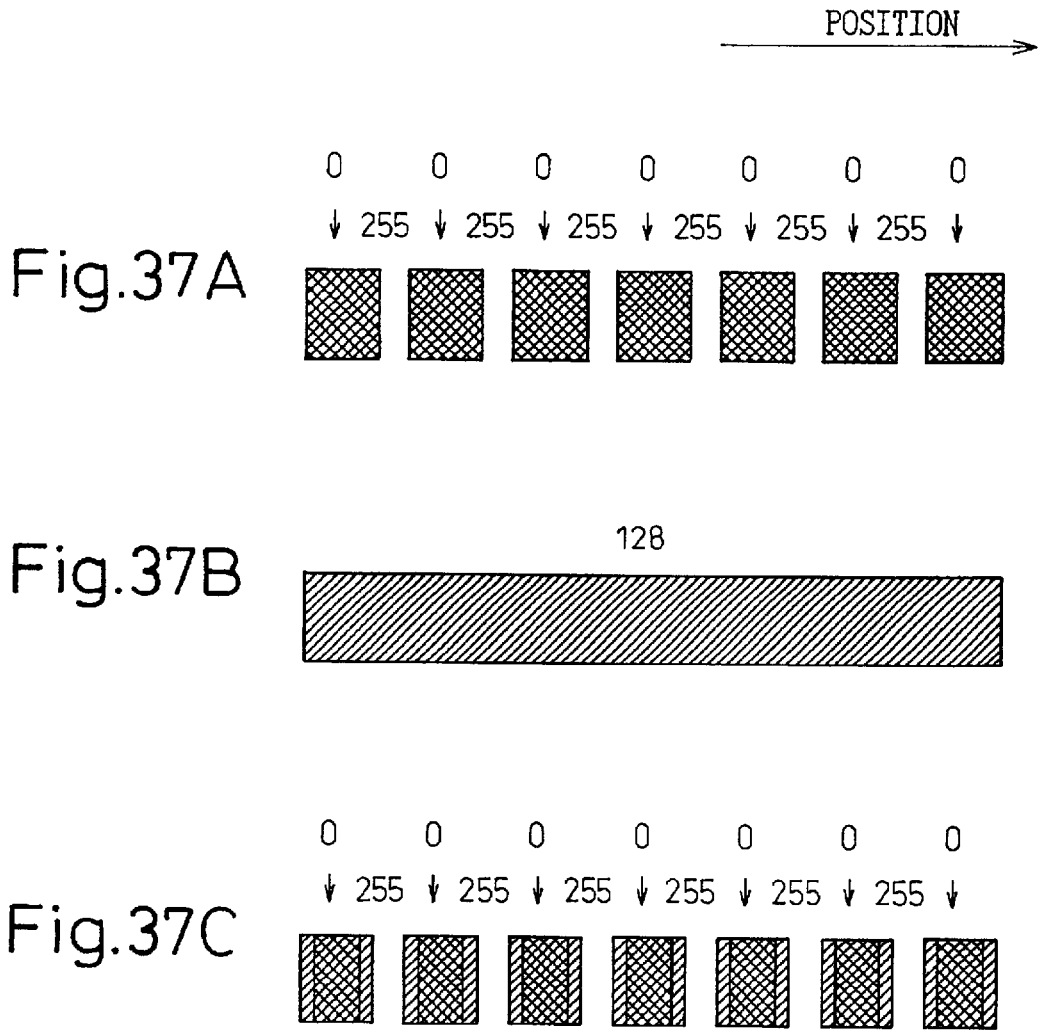
FIG. 37A, FIG. 37B and FIG. 37C are diagrams showing results of simulation for explaining the improvement in the resolution based on the application of the method of driving a display device according to the present invention.

FIG. 37A, FIG. 37B and FIG. 37C are diagrams showing results of simulation for explaining the improvement in the resolution based on the application of the method of driving a display device according to the present invention. These drawings show results of confirming the application of the virtual pixel technique relating to the present invention by computer simulation. Numbers (0 and 255) in FIG. 37A and FIG. 37C represent gradation levels.

Assume that the input image has a pattern of 0-1-0-1 (0-255-0-255) in a single color of the SXGA (refer to FIG. 37A). According to the ordinary system, the pattern becomes a uniform pattern of 0.5, for example, during the period of 0 to 1 because of the sampling timing (refer to FIG. 37B). As a result, it is not possible to regenerate the striped pattern. However, when the virtual pixel technique (the method of driving a display device) relating to the present invention is used, it is possible to regenerate an accurate original image as shown in FIG. 37C.

Figure 38A:
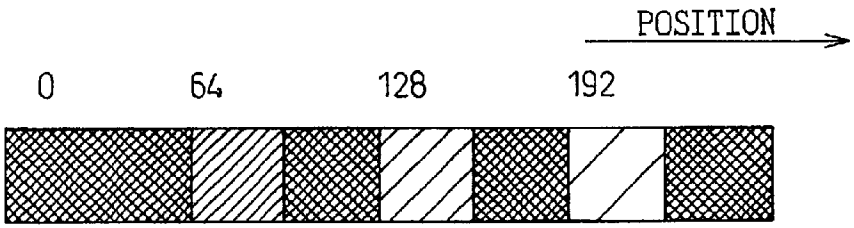
FIG. 38A, FIG. 38B and FIG. 38C are diagrams showing results of simulation when an interpolation method is used in parallel in the method of driving a display device according to the present invention.
Figure 38B:
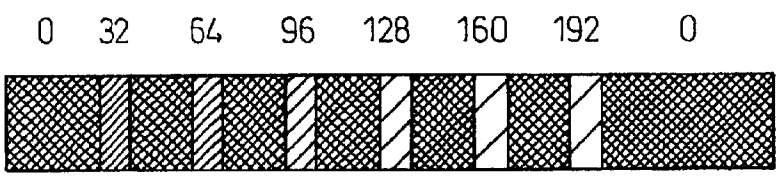
Figure 38C:
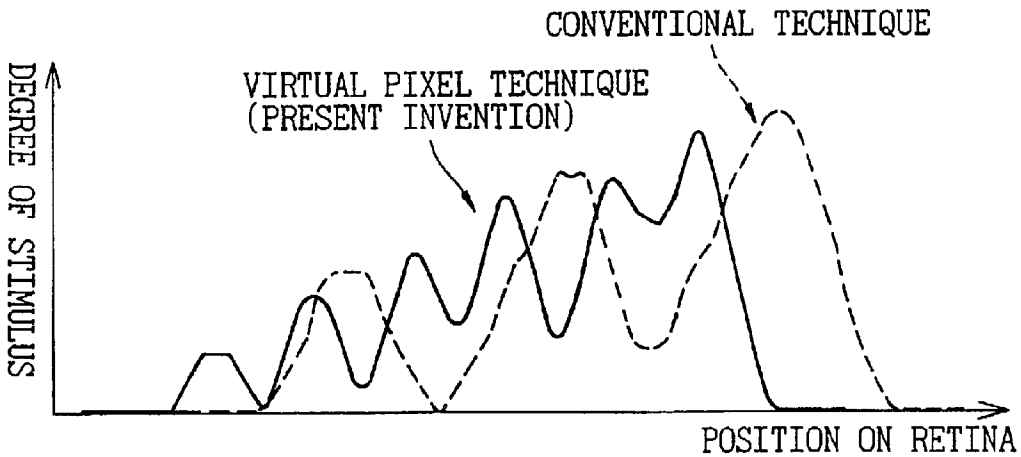

FIG. 38A, FIG. 38B and FIG. 38C are diagrams showing results of simulation when an interpolation method is used in parallel in the method of driving a display device according to the present invention.

When an input image has the resolution of the VGA (FIG. 38A), the information of the input image is increased based on an interpolation method (FIG. 38B). Then, the virtual pixel technique relating to the present invention is used to display the information of the input image to which the interpolation has been applied. As a result, it becomes possible to express the image to be visually confirmed in the resolution of the SXGA in the direction of motion of the image (FIG. 38C). In other words, when the interpolation method is used in parallel with the virtual pixel technique relating to the present invention, it becomes possible to input two data within the width of one pixel of the VGA. As a result, it becomes possible to express the image in further detail.

As explained above, based on the application of the virtual pixel technique relating to the present invention, it becomes possible to input information having information volume two times that of the actual image, in the motion direction of the image, even when the PDP has the VGA resolution characteristics. When the input image has the resolution of the SXGA, it is possible to accurately regenerate the information of the SXGA using the PDP having the VGA resolution. Further, when the input image has the VGA resolution, it is possible to increase the information of the image that is to be visually confirmed, by increasing the information volume using the interpolation method.

The method of driving a display device (the virtual pixel technique) relating to the present invention is effective in eight moving directions including horizontal and vertical directions and adjacent slated pixel directions. Further, according to the virtual pixel technique relating to the present invention, it is possible to improve the resolution of moving pictures based on only signal processing, without the need for changing a panel structure. In order to obtain sufficient gradation display characteristics, it is necessary to prepare sufficient number of subframes capable of obtaining 512 gradations in one TV frame. The switching speed two times that of the normal speed is required. At the present time, the driving of 32 SFs has been verified by the NTSC double scanning system, and therefore, it is possible to achieve the above-described 24 SFs.

The application of the virtual pixel technique of the present invention to color will be explained next.

Figure 30:
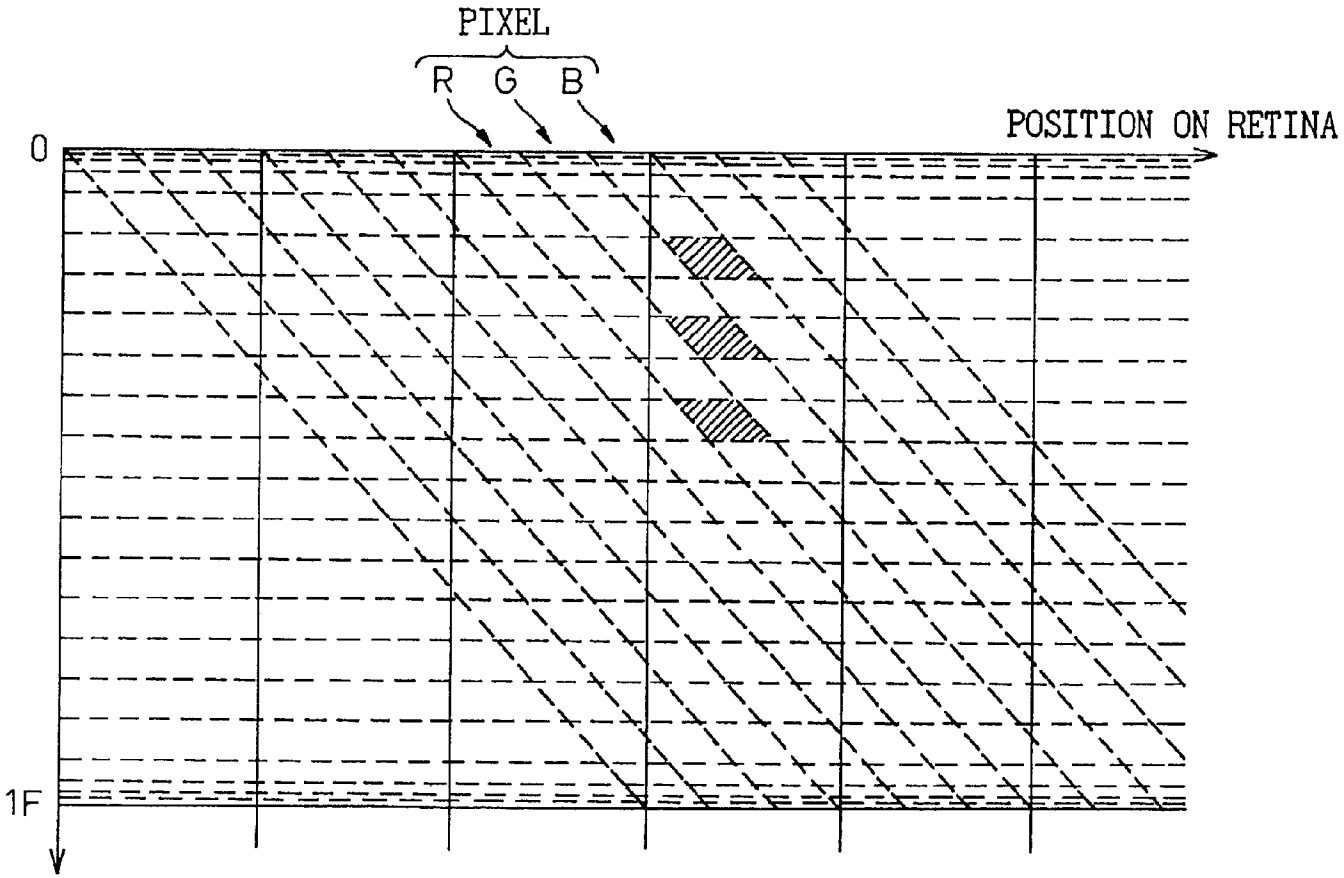
FIG. 30 is a diagram for explaining the expression of white color using R, G and B arrayed in order.

FIG. 30 is a diagram for explaining the expression of white color using R, G and B arrayed in order. In FIG. 30, a reference symbol R represents a sub-pixel of red color. G represents a sub-pixel of green color, and B represents a sub-pixel of blue color.

For expressing white color, conventionally, three sub-pixels of R, G and B arranged at positions in a horizontal direction are used. However, as shown in FIG. 30, when the virtual pixel technique of the present invention is used, it is possible to express white color using the three sub-pixels R, G and B "arranged in time". Based on this, it becomes possible to decrease the width necessary for expressing white color. As a result, the resolution improves substantially.

While one light-emitting block is selected for each of the colors R, G and B, it is also possible to select a plurality of light-emitting clocks for each color. It is also possible to arrange for all colors by changing proportions of R, G and B.

Figure 31:
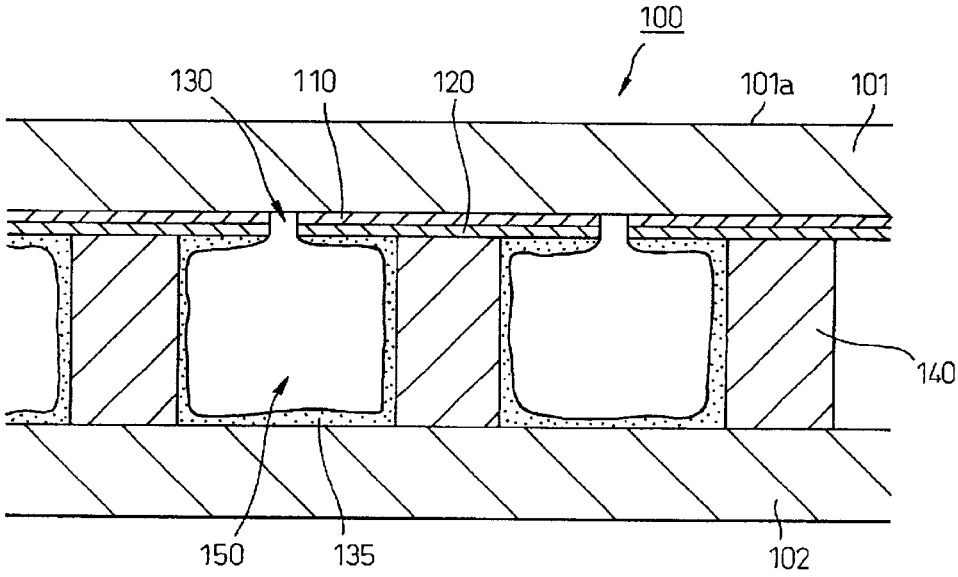
FIG. 31 is a cross-sectional view schematically showing one example of a structure of a plasma display panel (PDP) to which the present invention is applied.

FIG. 31 is a cross-sectional view schematically showing one example of a structure of a plasma display panel (PDP) to which the present invention is applied. In FIG. 31, a reference number 100 represents a PDP, 101 represents a front substrate, 101*a* represents a light-emission taking-out surface, and 102 represents a rear substrate. Further, a reference number 110 represents a nontranslucent black color dielectric, 120 represents a nontranslucent white color dielectric, 130 represents a slit, 135 represents an ultraviolet-ray excitation phosphor (phosphor), 140 represents a spacer, and 150 represents a discharge space.

As shown in FIG. 31, the slit 130 is formed by providing a space on the nontranslucent black color dielectric 110 and the nontranslucent white color dielectric 120 provided on the inner surface (the discharge space 150 side) of the front substrate 101. The phosphor 135 is coated on the front surface of the inner wall of the nontranslucent white color dielectric 120, to increase the light emission from the phosphor 135. Electrodes (for example, X electrodes, Y electrodes, and address electrodes) and protection films to be formed on the inner surfaces of the front substrate 101 and rear substrate 102 respectively are omitted from FIG. 31.

Figure 32:
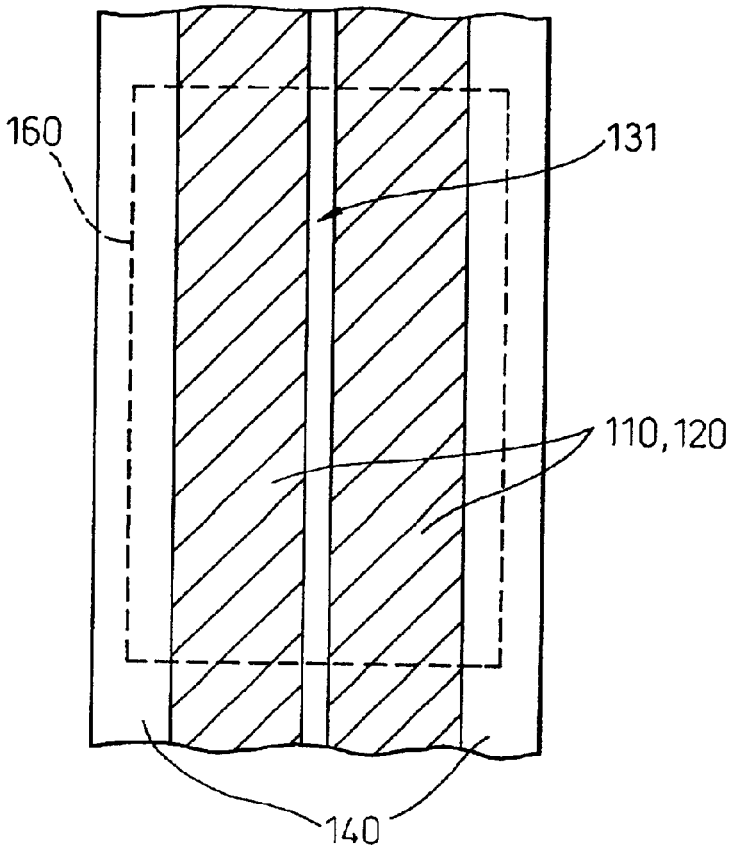
FIG. 32 is a diagram showing a case where slits are provided on the PDP in a vertical direction.
Figure 33:
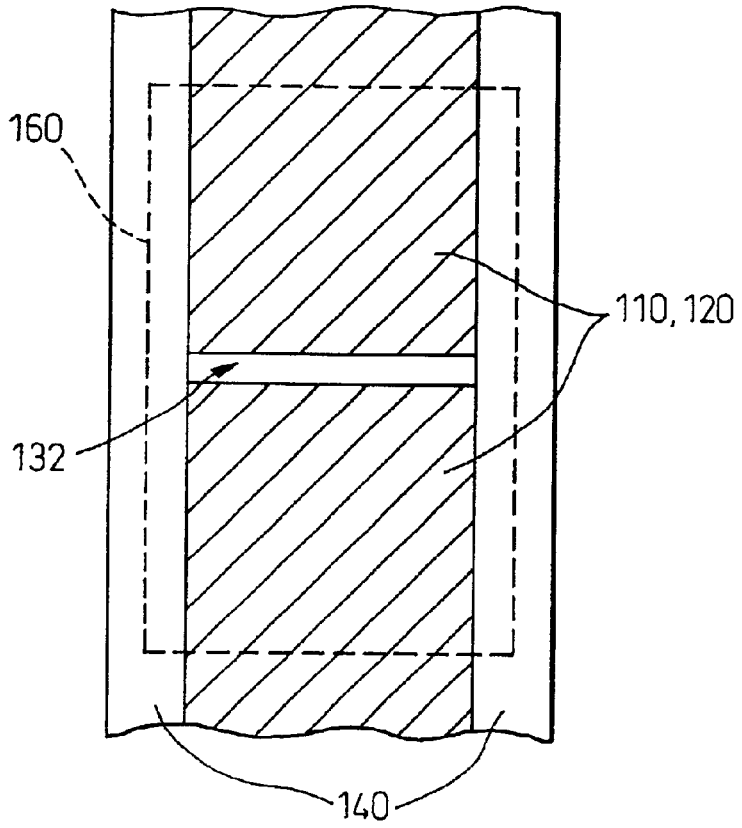
FIG. 33 is a diagram showing a case where slits are provided on the PDP in a horizontal direction.
Figure 34:
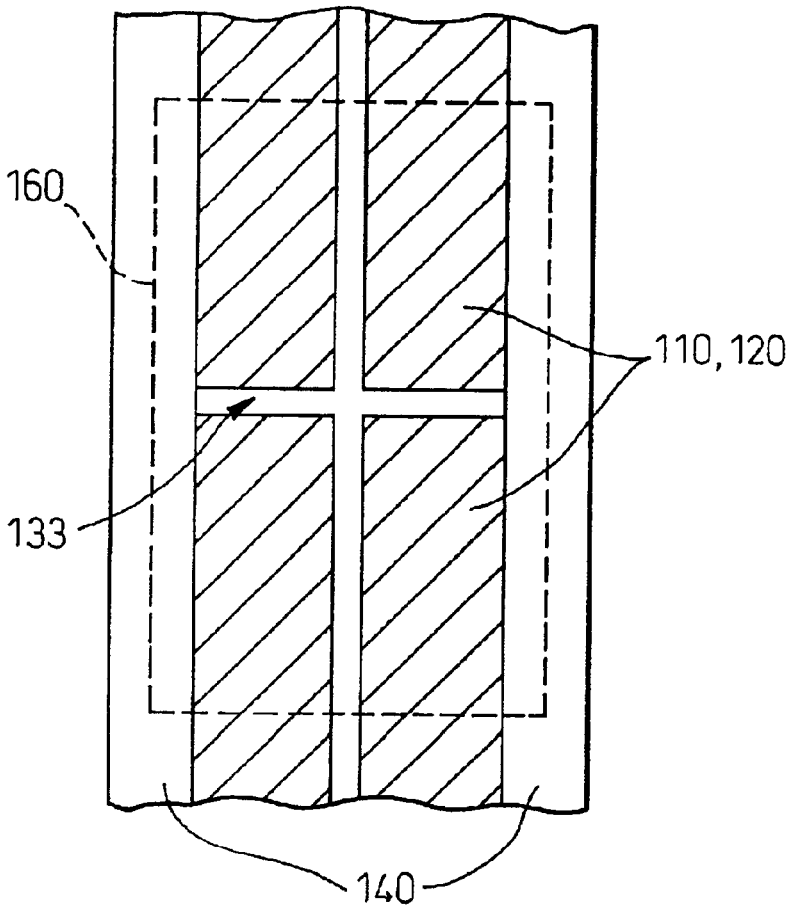
FIG. 34 is a diagram showing a case where slits are provided on the PDP in a cross shape.

FIG. 32 is a diagram showing a case where slits are provided on the PDP in a vertical direction. FIG. 33 is a diagram showing a case where slits are provided on the PDP in a horizontal direction. FIG. 34 is a diagram showing a case where slits are provided on the PDP in a cross shape. FIG. 32 to FIG. 34 show front views of the PDP respectively. A reference number 160 represents a sub-pixel, and 131 to 133 represent sits respectively.

As shown in FIG. 32 to FIG. 34, according to the method of increasing the resolution by using the virtual pixel technique of the present invention, it is possible to further increase the effect of high precision when the slits 130 (131 to 133) are provided at portions of extracting light emission of the discharge cells. Based on the provision of the slits, the width of light actually emitted from the panel becomes finer than when the slits are not provided. Therefore, based on the provision of the slits, it becomes possible to increase the number of virtual pixels corresponding to this decreased width.

The slits may be provided in the vertical direction at the center of the sub-pixels 160, as shown in FIG. 32. Alternatively, the slits may be provided in the horizontal direction at the center of the sub-pixels 160, as shown in FIG. 33. Alternatively, the slits may be provided in the cross shape at the center of the sub-pixels 160, as shown in FIG. 34.

When each slit shown in FIG. 32 and FIG. 33 is set to have a width of 1/k of the original width as 1, it is theoretically possible to increase the number of virtual pixels by k times. When the slits are formed in the cross shape as shown in FIG. 34, it is possible to increase the number of virtual pixels vertically and horizontally corresponding to the slits in the vertical direction and the slits in the horizontal direction respectively. When the slits are provided, it is also effective to coat phosphor on the portions facing the discharge cells, for improving the luminance. As shown in FIG. 31, it is also possible to provide slits in the double structure of black and white (the nontranslucent black color dielectric 110 and the nontranslucent white color dielectric 120), for improving the luminance by utilizing the internal reflection. It is also possible to set the sizes of the virtual pixels substantially equal to the width of the slits.

As described in detail, according to the present invention, the use of the virtual pixel technique makes it possible to reduce the moving picture counterfeit outline (pseudo counter of a moving picture) and to obtain a display of high resolution. It is also possible to improve the contrast in bright room. Further, it is also possible to improve the luminance and the luminous efficiency by increasing the phosphor-coated area.

Many different embodiments of the present invention may be constructed without departing from the spirit and scope of the present invention, and it should be understood that the invention is not limited to the specific embodiments described in this specification, except as defined in the appended claims.

What is claimed is:

1. A method of displaying a halftone image on a display panel by dividing one frame of the halftone image into a plurality of subframes each having a specific sustain discharge period to provide a specific intensity level, light emission of each subframe being controlled such that luminance of a pixel on a retina becomes substantially equal to the luminance of a pixel corresponding to an input image based on a move direction and a speed of motion of the input image that moves on the display panel, comprising the steps of:

preparing at least two subframes having the same intensity level in the plurality of subframes, where one halftone image is represented by at least two patterns of light-emitting subframes;

determining one pattern of light-emitting subframes by selecting subframes located close to a portion of a specific pixel on the retina; and controlling light emission of subframes in the determined one pattern based on positioning information of the subframes in the specific pixel on the retina, with priority, when the at least two subframes having the same intensity level are included in an area of the specific pixel on the retina.

2. The method of displaying a halftone image as claimed in claim 1, wherein the light emission of the subframes in the determined one pattern is controlled based on sequential subframes, with priority, when the positioning information of the at least two subframes having the same intensity level is the same.

3. The method of displaying a halftone image as claimed in claim 1, wherein the light emission of the subframes is controlled such that luminous colors of the specific pixel on the retina become substantially equal to luminous colors of the corresponding pixel in the input image.

4. A method of displaying a halftone image on a display panel by dividing one frame of the halftone image into a plurality of subframes each having a specific sustain discharge period to provide a specific intensity level, comprising the steps of:

preparing M sets of N subframes in the one frame;

setting a pitch of virtual pixels on the retina to 1/M-th pitch of real pixels on the display panel;

determining light emission of subframes to the virtual pixels on the retina based on a move direction and a speed of motion of the real pixels on the display panel; and controlling luminance of a virtual pixel on the retina having the 1/M-th pitch of real pixels on the display panel to become substantially equal to the luminance of a pixel corresponding to an input image.

5. The method of driving a display device as claimed in claim 4, wherein M is two and the pitch of the virtual pixels on the retina is a half of the pitch of the real pixels on the display panel, the two sets of N subframes are symmetrically provided for a front side and a later side of the one frame.

6. A display device displaying a halftone image by dividing one frame of the halftone image into a plurality of subframes each having a specific sustain discharge period to provide a specific intensity level, light emission of each subframe being controlled such that luminance of a pixel on a retina becomes substantially equal to the luminance of a pixel corresponding to an input image based on a move direction and a speed of motion of the input image that moves on the display panel, comprising:

a preparing unit preparing at least two subframes having the same intensity level in the plurality of subframes, where one halftone image is represented by at least two patterns of light-emitting subframes;

a determining unit determining one pattern of light-emitting subframes by selecting subframes located close to a portion of a specific pixel on the retina; and a controlling unit controlling light emission of subframes in the determined one pattern based on positioning information of the subframes in the specific pixel on the retina, with priority, when the at least two subframes having the same intensity level are included in an area of the specific pixel on the retina.

7. The display device as claimed in claim 6, wherein the controlling unit controls the light emission of the subframes in the determined one pattern based on sequential subframes, with priority, when the positioning information of the at least two subframes having the same intensity level is the same.

8. The display device as claimed in claim 6, wherein the controlling unit controls the light emission of the subframes such that luminous colors of the specific pixel on the retina become substantially equal to luminous colors of the corresponding pixel in the input image.

9. A display device displaying a halftone image by dividing one frame of the halftone image into a plurality of subframes each having a specific sustain discharge period to provide a specific intensity level, comprising:

a preparing unit preparing M sets of N subframes in the one frame;

a setting unit setting a pitch of virtual pixels on the retina to 1/M-th pitch of real pixels on the display panel;

a determining unit determining light emission of subframes to the virtual pixels on the retina based on a move direction and a speed of motion of the real pixels on the display panel; and a controlling unit controlling luminance of a virtual pixel on the retina having the 1/M-th pitch of real pixels on the display panel to become substantially equal to the luminance of a pixel corresponding to an input image.

10. The display device as claimed in claim 9, wherein M is two and the pitch of the virtual pixels on the retina is a half of the pitch of the real pixels on the display panel, the two sets of N subframes are symmetrically provided for a front side and a later side of the one frame.

11. A display device displaying an input image that moves on a display panel by constructing one frame with a plurality of subframes, comprising:

an assuming unit assuming a specific pixel on a retina based on the input image; and a control unit controlling light emission of each subframe such that luminance of the specific pixel on the retina becomes substantially equal to the luminance of a pixel corresponding to the input image, wherein slits are provided on a surface at an observer side of each light-emitting cell that constitutes the display panel, wherein the slits are formed substantially in a horizontal direction with respect to the light-emitting cells to limit the effective area of the light-extracting portions.

12. A display device displaying an input image that moves on a display panel by constructing one frame with a plurality of subframes, comprising:

an assuming unit assuming a specific pixel on a retina based on the input image; and a control unit controlling light emission of each subframe such that luminance of the specific pixel on the retina becomes substantially equal to the luminance of a pixel corresponding to the input image, wherein slits are provided on a surface at an observer side of each light-emitting cell that constitutes the display panel, wherein the slits are formed substantially in a vertical direction with respect to the light-emitting cells to limit the effective area of the light-extracting portions.

13. A display device displaying an input image that moves on a display panel by constructing one frame with a plurality of subframes, comprising:

an assuming unit assuming a specific pixel on a retina based on the input image; and a control unit controlling light emission of each subframe such that luminance of the specific pixel on the retina becomes substantially equal to the luminance of a pixel corresponding to the input image, wherein slits are provided on a surface at an observer side of each light-emitting cell that constitutes the display panel, wherein the slits are formed in a cross shape by combining substantially horizontal and vertical directions with respect to the light-emitting cells to limit the effective area of the light-extracting portions.

* * * * *

UNITED STATES PATENT AND TRADEMARK OFFICE

CERTIFICATE OF CORRECTION

PATENT NO. : 6,903,710 B2
DATED : June 7, 2005
INVENTOR(S) : Takayuki Ooe et al.

It is certified that error appears in the above-identified patent and that said Letters Patent is hereby corrected as shown below:

Title page,
*Primary Examiner*, change "Mongistu" to -- Mengistu --.

Signed and Sealed this

Twenty-first Day of March, 2006

JON W. DUDAS
*Director of the United States Patent and Trademark Office*